US007328980B2

(12) United States Patent
Saquib et al.

(10) Patent No.: US 7,328,980 B2
(45) Date of Patent: Feb. 12, 2008

(54) THERMAL PRINT HEAD TEMPERATURE ESTIMATION SYSTEM

(75) Inventors: Suhail S. Saquib, Shrewsbury, MA (US); Brian Busch, Sudbury, MA (US)

(73) Assignee: Zink Imaging, LLC, Waltham, MA (US)

( * ) Notice: Subject to any disclaimer, the term of this patent is extended or adjusted under 35 U.S.C. 154(b) by 0 days.

(21) Appl. No.: 11/524,476

(22) Filed: Sep. 20, 2006

(65) Prior Publication Data

US 2007/0064083 A1 Mar. 22, 2007

Related U.S. Application Data

(60) Provisional application No. 60/718,859, filed on Sep. 20, 2005.

(51) Int. Cl.
*B41J 2/05* (2006.01)

(52) U.S. Cl. ..... 347/57; 347/58; 347/59

(58) Field of Classification Search ..... 347/14, 347/15, 19, 56–59
See application file for complete search history.

(56) References Cited

U.S. PATENT DOCUMENTS 5,646,672 A 7/1997 Fukushima
6,132,030 A * 10/2000 Cornell ..... 347/57
6,183,056 B1 * 2/2001 Corrigan et al. ..... 347/14
6,819,347 B2 11/2004 Saquib et al.
2005/0007438 A1 1/2005 Busch et al.
2005/0068404 A1 3/2005 Saquib et al.

OTHER PUBLICATIONS

Suhail S. Saquib et al, A Real-Time Multi-Resolution Algorithm . . . , Proc. of IS&T-SPIE Elec. Imaging Sym., vol. 5674, pp. 269-281, San Jose, CA (2005).

Michael Unser, "Splines, A Perfect Fit for Signal and Image Processing", IEEE Signam Processing Magazine, pp. 22-38, Nov. 1999, IEEE.

Ashcroft et al., Solid State Physics, Saunders College Publishing, pp. 572-575 (1976).

* cited by examiner

*Primary Examiner*—Lam Son Nguyen
(74) *Attorney, Agent, or Firm*—Robert Platkin, PC

(57) ABSTRACT

A method estimates the temperature of a thermal print head element during printing. In one embodiment, the temperature is estimated using the resistance of the thermal print head element, which typically changes with the print head element temperature. The change in resistance of the print head element is exploited to indirectly estimate the temperature of the print head element.

18 Claims, 22 Drawing Sheets

THERMAL PRINT HEAD TEMPERATURE ESTIMATION SYSTEM

CROSS REFERENCE TO RELATED APPLICATIONS

This application claims the benefit of U.S. Provisional Patent Application Ser. No. 60/718,859, filed on Sep. 20, 2005, entitled "Thermal Print Head Temperature Estimation System," which is hereby incorporated by reference.

BACKGROUND

1. Field of the Invention

The present invention relates to thermal imaging processes and, more particularly, to techniques for estimating the temperature of thermal print head elements during thermal imaging processes.

2. Related Art

Thermal printers typically contain thermal print head (TPH) having a linear array of heating elements (also referred to herein as "print head elements") that print on an output medium by, for example, transferring pigment from a donor sheet to the output medium or by initiating a color-forming reaction in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of colorant to the output medium or the formation of color in the output medium. The density of the output produced by the print head element in this manner is a function of the amount of energy provided to the print head element. The amount of energy provided to the print head element may be varied by, for example, varying the amount of power provided to the print head element within a particular time interval or by providing power to the print head element for a longer time interval.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is calculated based on an assumption that the temperature of the print head element at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the calibrated temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density shift."

Furthermore, conventional thermal printers typically have difficulty accurately reproducing sharp density gradients between adjacent pixels in both the fast scan and slow scan direction. For example, if a print head element is to print a white pixel following a black pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

Various improved techniques exist for controlling the temperature of print head elements in a thermal printer to more accurately render digital images. Examples of such techniques have been described in U.S. Pat. No. 6,819,347 and in co-pending U.S. patent application Ser. No. 10/910,880, filed Aug. 4, 2004 (published as U.S. patent application Pub. No. U.S. 2005/0007438) and U.S. patent application Ser. No. 10/988,896, filed Nov. 15, 2004 (published as U.S. patent application Pub. No. US 2005/0068404).

Although such techniques have been effective to provide improved thermal images, nevertheless further improvements would be desirable, particularly in the thermal history control parameters. What is needed are techniques for estimating the unknown temperature of thermal print head elements during the imaging processes using the thermal print head.

SUMMARY

A method estimates the temperature of a thermal print head element. In one embodiment, the temperature is estimated using the resistance of the thermal print head element, which typically changes with the print head element temperature. The change in resistance of the print head element is exploited to indirectly estimate the temperature of the print head element.

The method employs a model for the temperature rise when energy is applied to the thermal print head element in conjunction with a model for mapping the resistance to temperature. The parameters of the model are obtained directly from the resistance measurements using a maximum likelihood estimator. It has been found that the MLE for jointly estimating the temperature model and resistance-temperature mapping tends to be biased. The factors which contribute to this bias have been identified and an analytical expression for the bias has been derived.

The resistance-temperature mapping of the thermal print head elements is estimated from resistance measurements made over a limited range of thermal print head heat sink temperatures. This model-based approach is capable of providing the functional relationship between the resistance of a thermal print head element and its temperature for temperatures much higher than those to which the heat sink can be heated without damaging the thermal print head.

In one aspect of the invention there is provided a method for estimating the temperature of a thermal print head element which includes collecting data and estimating parameters. The data collection may include setting an oven or other insulated chamber containing the thermal print head to a desired temperature, allowing the print head to thermally equilibrate with the oven temperature, applying energy to the thermal print head element to heat it (such as by turning on current to the print head element for a fixed duration and at a fixed power level), applying a probing pulse to the thermal print head element to obtain resistance measurements, and repeating these steps for different oven temperatures and applied powers.

The parameter estimation may include estimating a parameter A of the temperature model, and estimating the resistance-temperature mapping $f(\cdot)$ by minimizing the weighted mean square temperature error between the two models, and repeating and refining these estimations by using the estimate of $f(\cdot)$ to recompute the weights.

The estimated temperature model parameter A represents the temperature rise in the thermal print head element when unity power is applied to the print head element for a fixed duration. Manufacturing tolerances in the different coatings of the thermal print head may result in different temperature rises between print heads for the same applied power. These differences may lead to varying print head responses and need to be calibrated out to ensure consistent image quality across printers. The estimated A may be utilized to achieve this compensation. For example, the power P applied to the print head element may be set such that PA remains constant from print head to print head, or from print head element to print head element.

The normalized resistance-temperature mapping is a characteristic of the material used to construct the print head elements. Once estimated for a single print head, it may be used on other print heads to infer the temperature of the heating elements by measuring their electrical resistance. Such a measurement may be conducted on-line while printing to compensate for the temperature rise of the print head or off-line to learn the parameters of a thermal history compensation algorithm.

In one aspect of the invention, a method is provided for identifying an estimate $\hat{f}(\cdot)$ of a function $T_h=f(R_h)$ relating resistance $R_h$ of a thermal print head element in a thermal print head of a thermal printer to temperature $T_h$ of the thermal print head element. The method includes: (A) selecting a plurality N of initial temperatures $T_{si}$; (B) heating an insulated chamber containing the thermal print head to the plurality of initial temperatures $T_{si}$; (C) providing the thermal print head element with a plurality N of input energies $P_i$; (D) measuring a plurality N of resistances $R_{hi}$ resulting from application of the plurality of input powers $P_i$; and (E) identifying the estimate $\hat{f}(\cdot)$ based on the plurality of initial temperatures $T_{si}$, the plurality of resistances $R_{hi}$, and the plurality of input powers $P_i$.

In another aspect of the present invention, a method is provided which includes: (A) identifying a first plurality of estimates of a parameter A for a first plurality of print head elements in a first thermal print head, wherein the equation $T_h=T_s+AP$ relates thermal print head element temperature $T_h$ to a heat sink temperature $T_s$ and input power P; (B) identifying a first average value of the first plurality of estimates; (C) identifying a second plurality of estimates of the parameter A for a second plurality of print head elements in a second thermal print head; (D) identifying a second average value of the second plurality of estimates; and (E) adjusting a first input energy provided to the first thermal print head and a second input energy provided to the second thermal print head based on a function of the first average value and the second average value.

In yet another aspect of the present invention, a method is provided which includes: (A) identifying a first estimate of a parameter A for a first print head element in a first thermal print head, wherein the equation $T_h=T_s+AP$ relates thermal print head element temperature $T_h$ to a heat sink temperature $T_s$ and input power P; (B) identifying a second estimate of the parameter A for a second print head element in the first thermal print head; and (C) adjusting a first input energy provided to the first thermal print head element and a second input energy provided to the second thermal print head element based on a function of the first estimate and the second estimate.

In still a further aspect of the present invention, a method is provided for estimating a temperature $T_h$ of a print head element in a thermal print head. The method includes: (A) identifying an estimate $\hat{f}(\cdot)$ of a function $T_h=f(R_h)$ relating print head element resistance $R_h$ to print head element temperature $T_h$; (B) identifying a resistance $R_h$ of the print head element; and (C) estimating the temperature $T_h$ of the print head element based on the estimate $\hat{f}(\cdot)$ and the resistance $R_h$.

Other features and advantages of various aspects and embodiments of the present invention will become apparent from the following description and from the claims.

DETAILED DESCRIPTION

Figure 1A:
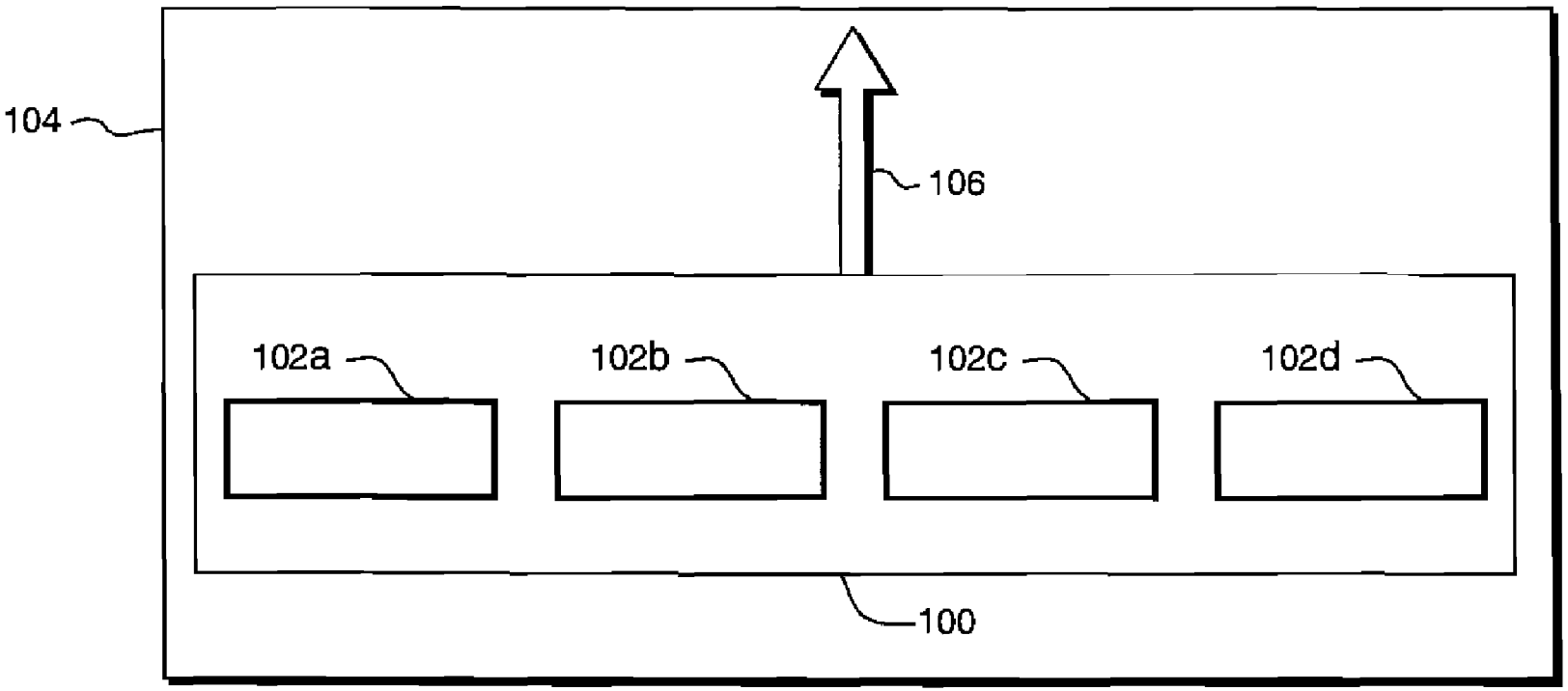
FIG. 1A (PRIOR ART)
FIG. 1 is a diagram of a conventional thermal print head and its output.

Before describing particular embodiments of the present invention, the operation of conventional thermal printers will be described by way of background. Referring to FIG. 1A, in a conventional bilevel thermal printer, a print head 100 includes a linear array of heating elements 102*a-d* (also referred to herein as "print head elements"). Although only four heating elements 102*a-d* are shown in FIG. 1A, it should be appreciated that a typical thermal print head includes a large number of small heating elements that are closely spaced at, for example, 300 elements per inch. Although the print head 100 in block diagram form in FIG. 1A is shown printing spots of a single color (such as black), thermal printers may have multicolor donor ribbons capable of printing spots of multiple colors. Furthermore, it should be appreciated that the heating elements 102*a-d* in the print head 100 may be of any shape and size, and may be spaced apart from each other at any appropriate distances and in any configuration.

The thermal print head 100 typically produces output on an output medium 104 (such as plain paper) as follows. For purposes of illustration, only a portion of the output medium 104 is shown in FIG. 1A. The output medium 104 moves underneath the print head 100 in the direction indicated by arrow 106. Delivering power to a particular print head element heats the print head element. When the element's temperature passes some critical temperature, it begins to transfer pigment (ink or wax) to the area of the output medium 104 that is currently passing underneath the heating element, creating what is referred to herein as a spot, or dot. The print head element will continue to transfer pigment to the output medium for as long as power is delivered to the print head element, and the temperature is above the critical temperature. A larger spot (or dot) may therefore be printed by delivering power to the print head element for a longer period of time. These larger spots are often referred to as "dots."

A printer controller (not shown) inside the thermal printer is capable of selectively delivering power to any combination of the print head elements 102*a-d* at any particular time. Printer controllers in conventional thermal printers divide time into equal intervals of duration $T_c$, each of which is referred to herein as a "print head cycle."

Figure 1B:
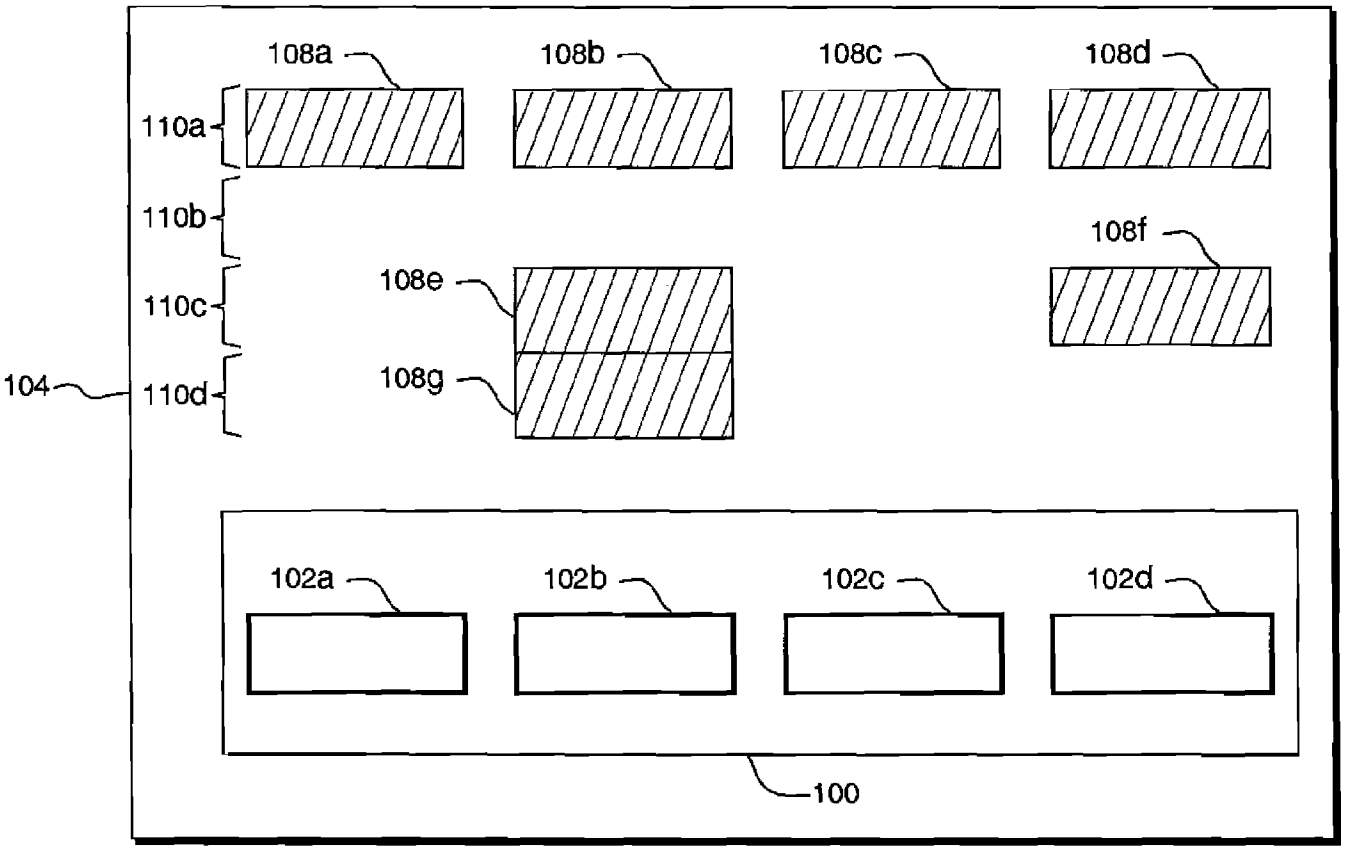
FIG. 1B (PRIOR ART)

Referring to FIG. 1B, an example of a pattern of spots 108*a-g* printed by the print head 100 on the output medium 104 is shown. The output medium 104 is shown after the print head 100 has produced output for four print head cycles. Each of the rows 110*a-d* contain spots that were printed during a single one of the print head cycles. It should therefore be understood in general how a conventional thermal printer may produce desired patterns of spots on the output medium 104 by selectively activating thermal print head elements 102*a-d* during successive print head cycles. Note that although for ease of illustration the spots 108*a-g* in FIG. 1B are shown as solely growing in the vertical (down web) direction, in practice the spots 108*a-g* also grow in the horizontal (cross web) direction.

Having described prior art techniques for use by thermal printers, aspects of embodiments of the present invention will now be described. The resistivity of the material chosen for fabricating the heating elements 102*a-d* of the thermal print head (TPH) 100 typically exhibits some temperature dependence. This property has been used to actively control the heating element to maintain a desired temperature. Other applications include an offline calibration procedure to remove TPH-TPH variability, and estimation of the thermal model parameters for improved thermal history control.

All of these applications require the resistance-temperature mapping of the thermal print head element in its operating temperature range, which is much higher than the maximum allowable heat sink temperature. Techniques are disclosed herein for estimating this mapping based on measurements of thermal print head element resistance made over a limited range of TPH heat sink temperatures. Such estimation may use a model for predicting the TPH element temperature as a function of applied power in conjunction with a model for the resistance-temperature mapping. This model-based approach is capable of learning the functional relationship between the TPH element's resistance and its temperature for temperatures much higher than the maximum allowable heat sink temperature.

Figure 2:
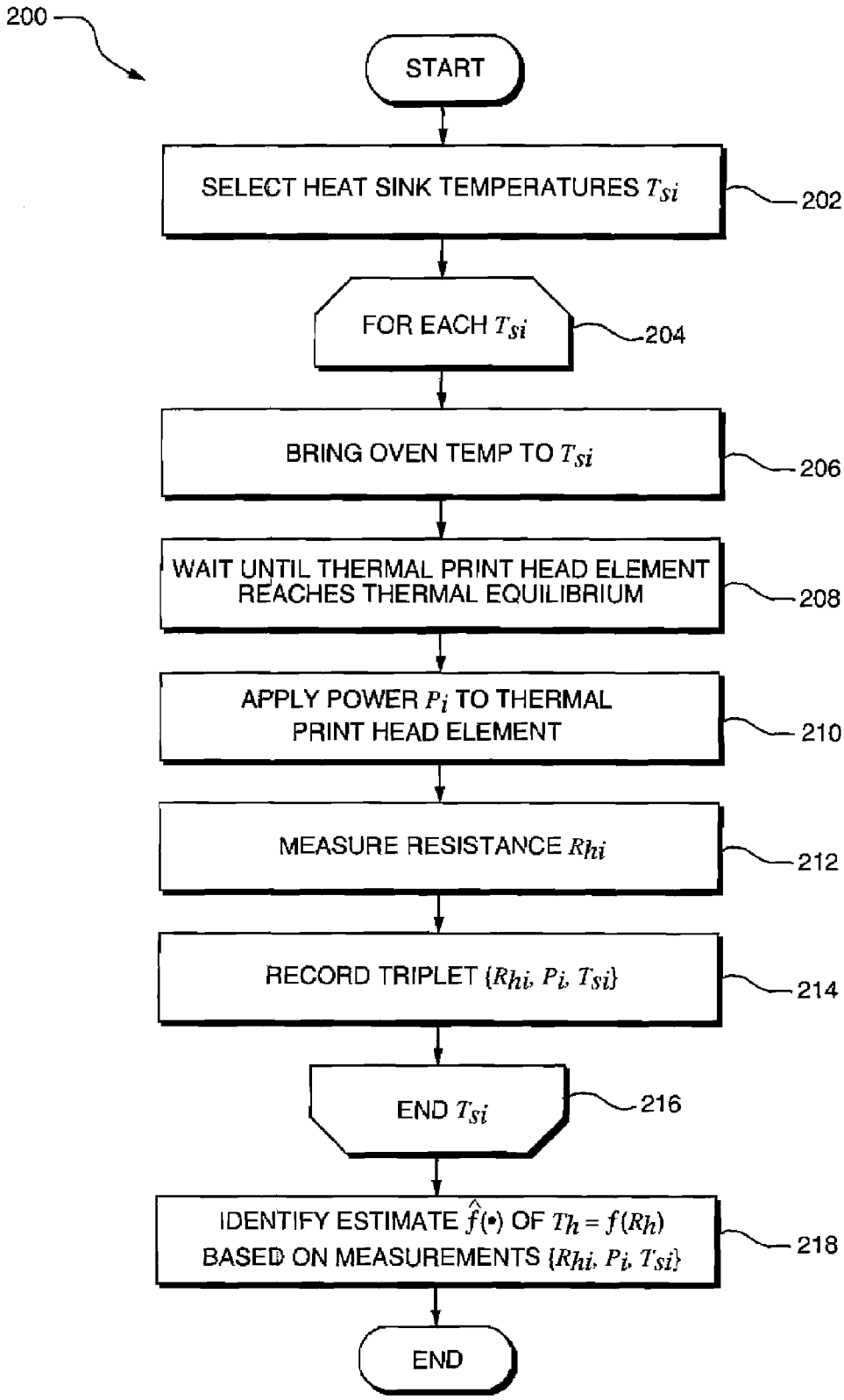
FIG. 2 is a flowchart of a method performed according to one embodiment of the present invention to generate a resistance-temperature mapping for a particular thermal print head element in a thermal print head.

For example, referring to FIG. 2, a flowchart is shown of a method 200 that is performed according to one embodiment of the present invention to generate a resistance-temperature mapping for a particular thermal print head element in a thermal print head. A plurality of heat sink temperatures $T_{si}$ are selected, where i ranges from 1 to the number of measurements N (step 202). The thermal print head is placed in an oven or other heating mechanism which is relatively well-insulated against its surroundings, to ensure that the interior temperature is relatively uniform. The method 200 enters a loop over each of the heat sink temperatures $T_{si}$ (step 204). The oven is brought to temperature $T_{si}$ (step 206), and the thermal print head is allowed to reach thermal equilibrium (step 208). Power $P_i$ is applied to the thermal print head element for some predetermined time period (step 210). The value of $P_i$ may be constant across values of i or may vary. In general, it is desirable to select values of $P_i$ falling within the range of powers expected to be applied to the thermal print head element under normal operating conditions.

The resistance $R_{hi}$ of the print head element is measured at the end of the predetermined time period (step 212). The resistance-power-temperature triplet $(R_{hi},P_i)T_{si})$ is recorded (step 214). Steps 206-214 are repeated for the remaining heat sink temperatures (step 216). The same techniques may be applied to other print head elements in the print head to produce additional sets of measurement triplets.

Figure 3:
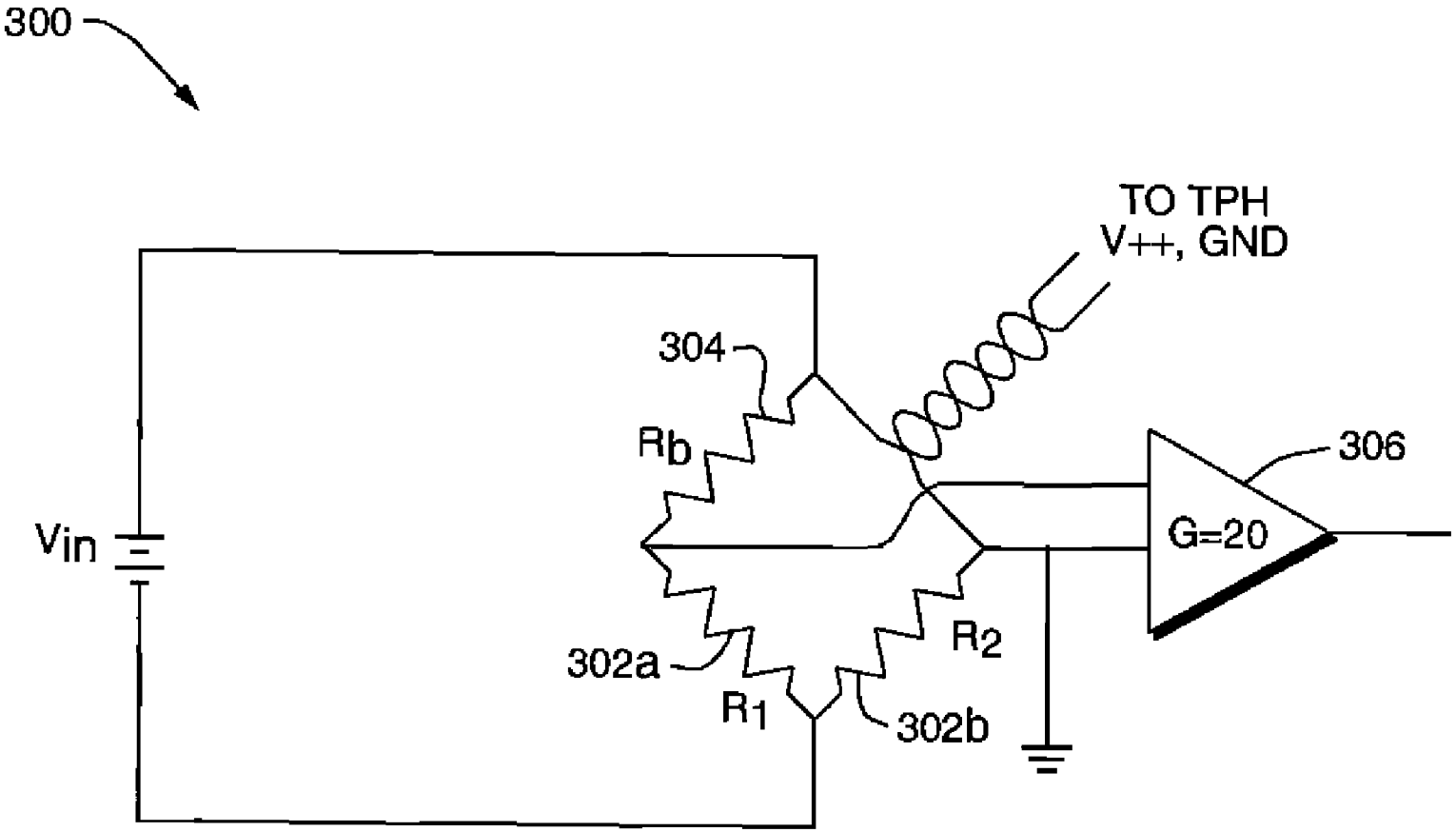
FIG. 3 is a schematic diagram of a resistance measurement apparatus according to one embodiment of the present invention.

Referring to FIG. 3, a resistance measurement apparatus 300 is shown having a classical bridge configuration that may be used in one embodiment of the present invention to perform the resistance measurements described with respect to step 212 of FIG. 2. This is a classical bridge configuration. The resistors $R_1$ 302*a* and $R_2$ 302*b* are chosen to be small (≈10 Ω) to minimize any RC time-constant delays in the measurement system, and the resistor $R_b$ 304 is chosen to approximately match the thermal TPH (TPH) resistance (to within ±100 Ω). When current is turned on to an element of the print head, the currents in the two arms of the bridge 300 are nearly equal and the voltage sampled by the op-amp 306 (gain G=20) is nearly zero. Batteries supply all electrical power to the circuit 300 in order to minimize noise, and all supply voltages are regulated (not shown). The resistance values shown in FIG. 3 are merely for illustrative purposes and do not constitute limitations of the present invention.

The op-amp 306 is chosen to have a high gain-bandwidth product (>400 MHz), and low noise, to allow for high-speed measurements of the instantaneous resistance (the final system settling time is ≈0.5 μs). The op-amp's gain (G) and input offset ($V_{off}$), as well as the exact values of $R_1$ and $R_2$ are carefully calibrated using fixed, precision resistors in place of the thermal print head. To eliminate the effects of temperature drift on the resistors 302*a-b* and 304 and the op-amp 306, the entire circuit board is kept in an insulated box maintained at a constant temperature (+0.5 degrees C.).

The output of the op-amp ($V_{out}$) is recorded on a digitizing oscilloscope for analysis. Also recorded is the input voltage $V_{in}$. The instantaneous resistance is computed using Equation 1:

$$R_h = \frac{GR_2R_bV_{in} + R_2(R_1 + R_b)(V_{out} - GV_{off})}{GR_1V_{in} - (R_1 + R_b)(V_{out} - GV_{off})} \quad \text{Equation 1}$$

As described above with respect to FIG. 2, resistance measurements may be made for a variety of initial heat-sink temperatures $T_{si}$ of the print head after applying power for a predetermined duration of time ("on-time"). The final resistance measurement may be obtained by averaging the instantaneous resistance of Equation 1 over a short duration to reduce noise.

Let $T_h=f(R_h)$ denote the unknown function that maps the resistance $R_h$ of a print head element to its temperature $T_h$. The function $f(\cdot)$ is a characteristic of the material used to construct the print head elements. An estimate $\hat{f}(\cdot)$ of the function $f(\cdot)$ may be obtained based on the resistance, power, and temperature measurements $\{R_{hi},P_i,T_{si}\}$ described above (FIG. 2, step 218).

Figure 4:
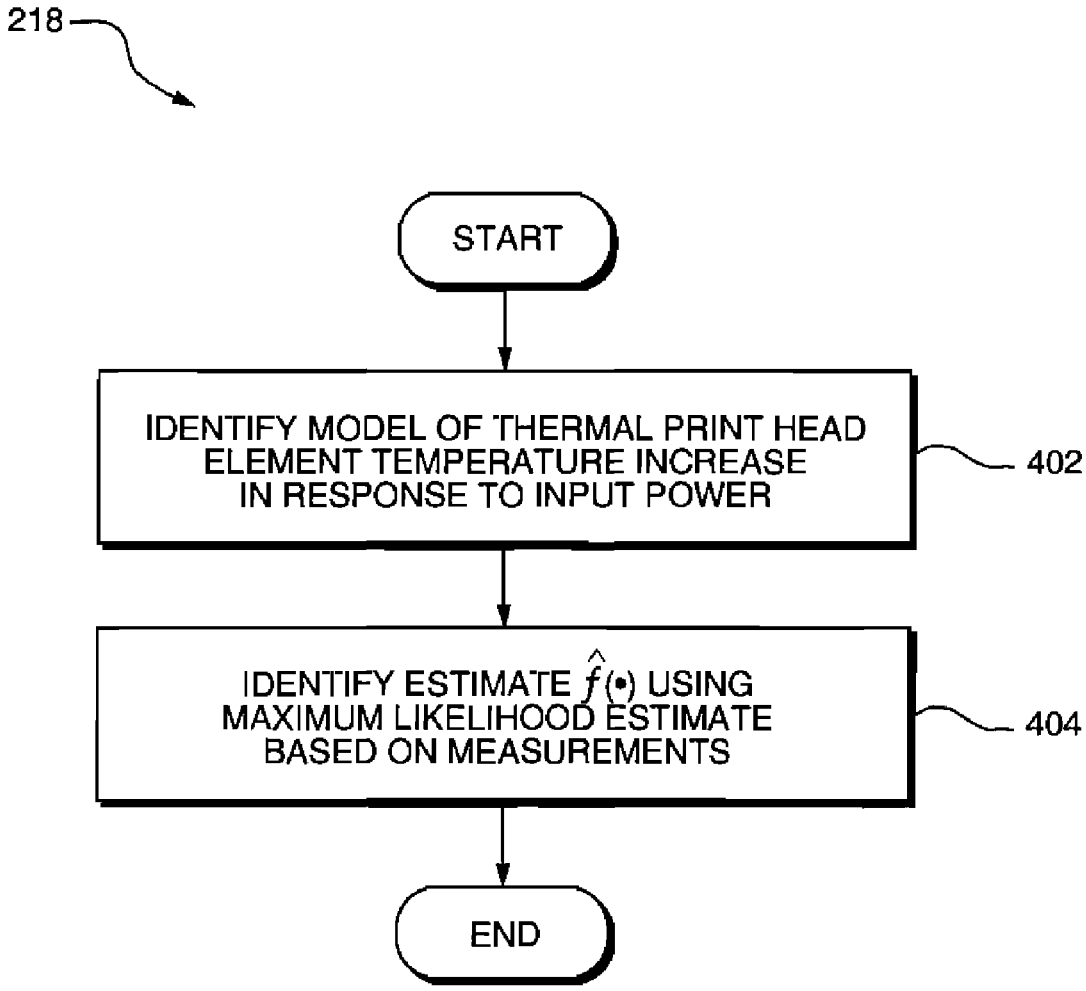
FIGS. 4-10 are flowcharts of methods for obtaining an estimate of a resistance-measurement function according to one embodiment of the present invention.

Examples of techniques for providing the estimate $\hat{f}(\cdot)$ will now be described in more detail. Referring to FIG. 4, a flowchart is shown of a method for implementing step 218 of FIG. 2, in which the estimate $\hat{f}(\cdot)$ is obtained.

As described above with respect to steps 206-208 of FIG. 2, the print head may be placed in a temperature-controlled environment and be allowed to come to thermal equilibrium with the surrounding before any measurements are made. This allows accurate measurement of the initial temperature of the heating elements before current is applied to them. However, in the process of measuring the resistance $R_{hi}$, some current has to be supplied to the print head element, thereby raising its temperature. Consequently, the temperature at which the resistance measurement is made is not known even though the initial temperature $T_{si}$ is known (since the heating element is allowed to come to thermal equilibrium). Therefore a model is needed of the increase in the temperature $T_h$ of the thermal print head element, relative to the heat sink temperature $T_s$, in response to application of input power P for a predetermined duration. Such a model may be used to predict the temperature $T_h$ of the print head element based on the (known) heat sink temperature $T_s$ and the (known) input power P. Referring again to FIG. 4, a model of print head element temperature increase is identified (step 402). Such a model may be identified in any of a variety of ways, such as those described below.

First consider the case where the measurements are always made after the heating element is turned on for a fixed time interval. Input power $$P = \frac{V_{in}^2 R_h}{(R_h + R_2)^2}$$

may be applied to the thermal print head element for a fixed duration. Although the applied power may actually vary during the heating element on-time because $R_h$ varies as the heating element heats up, a typical thermal print head has a large $R_h$ and a small $df^{-1}(T_h)/dT_h$. As a result, the percent change in power during the on-time is negligible and may be ignored.

In the case where the input power P is applied for a fixed on-time, the rise in the temperature $T_h$ of the heating element relative to the heat-sink temperature $T_s$ is proportional to the input power P, as given by Equation 2. In Equation 2, A is a temperature model parameter that converts the applied power P to temperature.

$$T_h=T_s+AP, \quad \text{Equation 2}$$

Equation 2 may be used to relate the resistance measurements $R_h$ to the heat-sink temperatures $T_s$ and applied power P, as given by Equation 3.

$$f(R_h)=T_s+AP \quad \text{Equation 3}$$

Recall that the measurement triplet is denoted as $\{R_{hi}, T_{si},P_i\}$, where the subscript i ranges from 1 to the number of measurements N. Using Equation 3 and assuming the measurements are corrupted by Gaussian noise, the estimate $\hat{f}(\cdot)$ may be obtained using a maximum likelihood estimator given by Equation 4 (FIG. 4, step 404) to produce estimates for the function $f(\cdot)$ and A.

$$[\hat{f}(\cdot), \hat{A}] = \underset{f(\cdot),A}{\operatorname{argmin}} \sum_{i=1}^{N} \frac{1}{\sigma_i^2}(f(R_{hi}) - T_{si} - AP_i)^2 \quad \text{Equation 4}$$

In Equation 4, $\sigma_i$ is the standard deviation of the noise on the print head element temperature arising from noise in the measurement triplet. In practice, the noise on the resistance measurements ($\sigma_R$) dominates and $\sigma_i$ may be approximated by Equation 5, in which $f'(\cdot)$ is the first derivative of $f(R_{hi})$ with respect to $R_{hi}$.

$$\sigma_i = f'(R_{hi})\sigma_R \quad \text{Equation 5}$$

Therefore, in another embodiment, the estimate $\hat{f}(\cdot)$ may be obtained using a maximum likelihood estimator to produce estimates for the function $f(\cdot)$ and A by substituting Equation 5 into Equation 4, resulting in Equation 6 (FIG. 4, step 404).

$$[\hat{f}(\cdot), \hat{A}] = \underset{f(\cdot), A}{\operatorname{argmin}} \sum_{i=1}^{N} \frac{1}{f'(R_{hi})^2}(f(R_{hi}) - T_{si} - AP_i)^2 \quad \text{Equation 6}$$

As described above, Equation 4 or Equation 6 may be used to provide the estimate $\hat{f}(\cdot)$ in step 218 of FIG. 2. Examples of techniques will now be described for formulating non-parametric models of $f(\cdot)$ to facilitate the optimization of Equation 4 and Equation 6.

Equation 7 illustrates a $p^{th}$ order polynomial representation for $f(\cdot)$, where $x_j$, j=0, . . . , p are the polynomial coefficients.

$$f(R)=x_p R_h^p + x_{p-1} R_h^{p-1} + \ldots + x_0, \quad \text{Equation 7}$$

Figure 5:
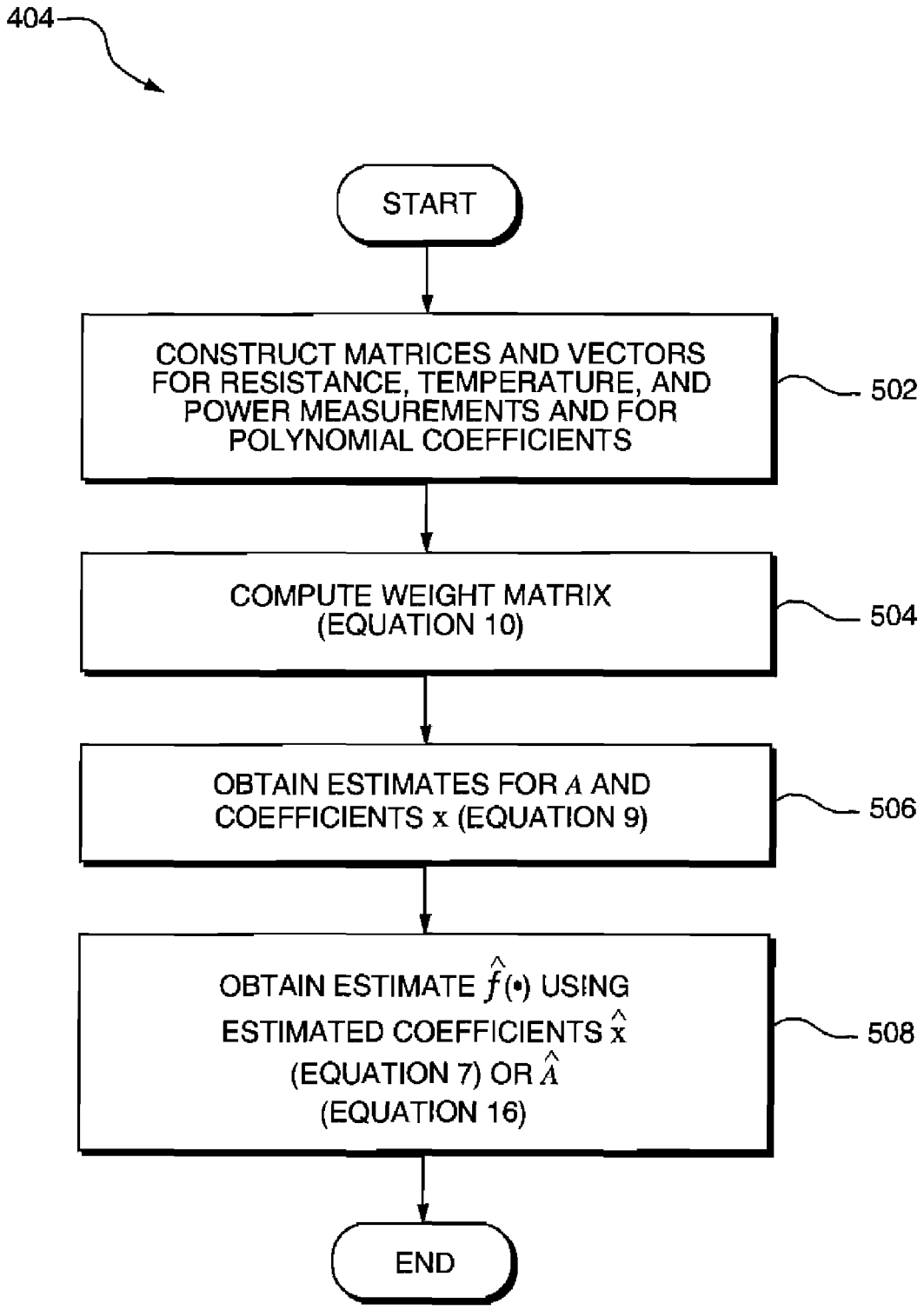

Equation 8 shows matrices and vectors (denoted by bold letters) that may be constructed from the measurements and unknown variables. Referring to FIG. 5, a flowchart is shown of a method that may be used to implement step 404 of FIG. 4 (estimation of $f(\cdot)$) based on Equation 4. The method begins by constructing the matrices and vectors in Equation 8 (step 502).

$$R_h^p = \begin{bmatrix} R_{h1}^p & \cdots & 1 \\ \vdots & & \vdots \\ R_{hN}^p & \cdots & 1 \end{bmatrix}, \quad \text{Equation 8}$$

$$T_s = \begin{bmatrix} T_{s1} \\ \vdots \\ T_{sN} \end{bmatrix},$$

$$P = \begin{bmatrix} P_1 \\ \vdots \\ P_N \end{bmatrix},$$

$$x = \begin{bmatrix} x_p \\ \vdots \\ x_0 \end{bmatrix}$$

The solution to Equation 4 is given by Equation 9 (step 506), where W is a diagonal weight matrix defined by Equation 10 (step 504), and where D is a matrix defined by Equation 11. An estimate $\hat{f}(\cdot)$ is obtained using the estimated coefficients $\hat{x}$ and Equation 7 (step 508).

$$\begin{bmatrix} \hat{x} \\ \hat{A} \end{bmatrix} = (D^T W D)^{-1} D^T W T_s \quad \text{Equation 9}$$

$$W = \begin{bmatrix} 1/\sigma_1^2 & & \\ & \ddots & \\ & & 1/\sigma_N^2 \end{bmatrix} \quad \text{Equation 10}$$

$$D = [\, R_h^p \quad -P \,] \quad \text{Equation 11}$$

In one embodiment, Equation 6 is solved as follows. Note that in Equation 6 the weight matrix W depends on the derivative of a function that is being estimated. In one embodiment, Equation 6 is solved by estimating the parameters iteratively using Equation 9. At each iteration, the weight matrix is recomputed by Equation 12, using the function $\hat{f}(\cdot)$ estimated in the previous iteration.

$$W = \begin{bmatrix} 1/\hat{f}'(R_{h1})^2 & & \\ & \ddots & \\ & & 1/\hat{f}'(R_{hN})^2 \end{bmatrix} \quad \text{Equation 12}$$

Figure 6:
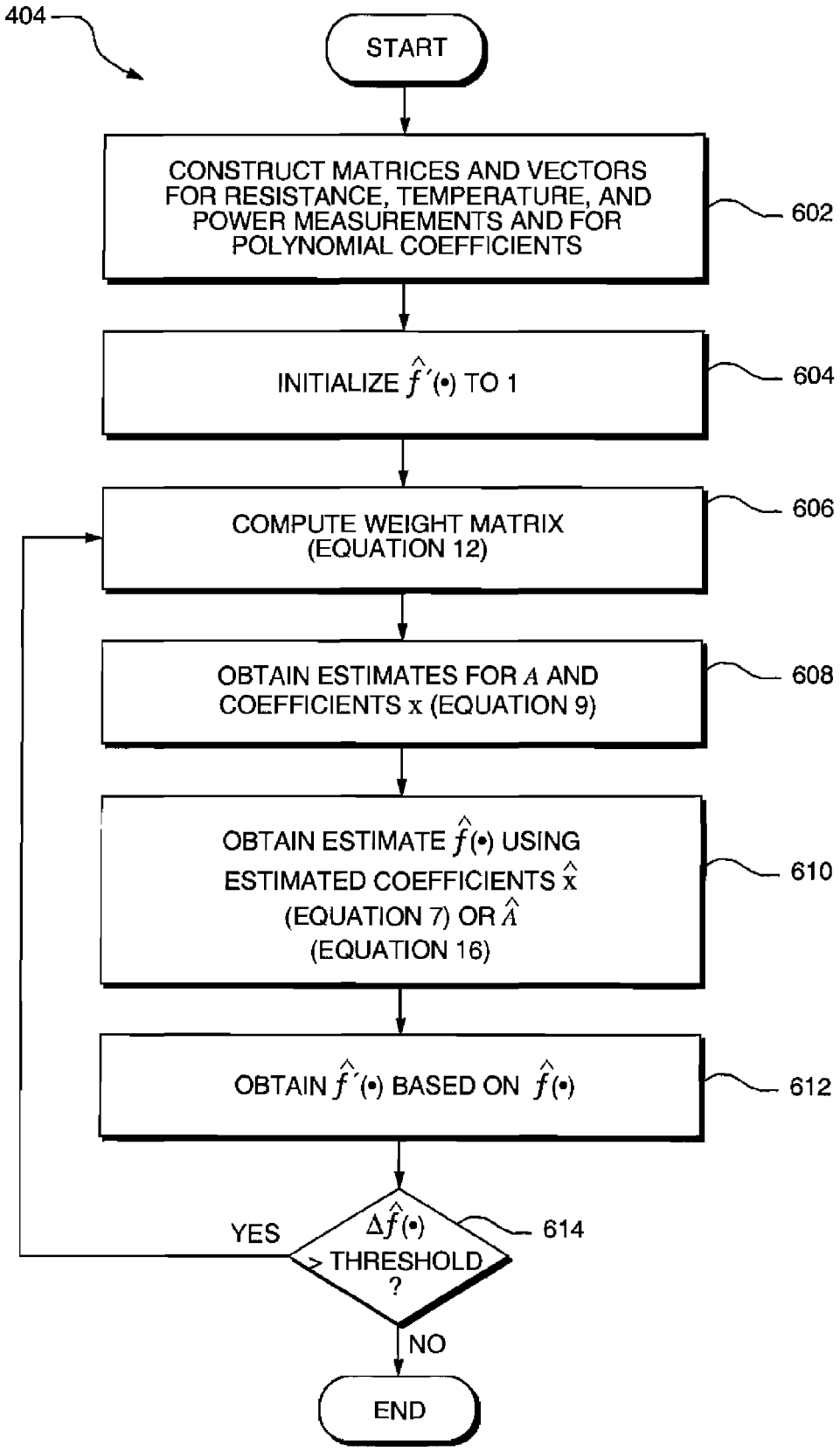

For example, referring to FIG. 6, a flowchart is shown of a method that may be used to implement step 404 of FIG. 4 (estimation of $f(\cdot)$) based on Equation 6. The matrices and vectors are constructed in the same manner as described above with respect to step 502 of FIG. 5 (FIG. 6, step 602). An estimate $\hat{f}'(\cdot)$ of the derivative of $f(\cdot)$ is initialized to one (step 604). The weight matrix W is computed using Equation 12 based on the initial estimate $\hat{f}'(\cdot)$ (step 606). Estimates for $\hat{x}$ and $\hat{A}$ are obtained using Equation 9 (step 608). An estimate $\hat{f}(\cdot)$ is obtained using the estimated coefficients $\hat{x}$ and Equation 7 (step 610). A new estimate $\hat{f}'(\cdot)$ is computed based on $\hat{f}(\cdot)$ (step 612).

Steps 606-612 may be repeated as many times as desired. For example, the current value of $\hat{f}(\cdot)$ may be compared to the value of $\hat{f}(\cdot)$ from the previous iteration of steps 606-612. If the difference is greater than some predetermined threshold value (step 614), steps 606-612 may be repeated. Otherwise, the method shown in FIG. 6 terminates. In this way, the estimate of $\hat{f}(\cdot)$ is refined until it converges on a final value to within the predetermined threshold tolerance.

It has been found that a global polynomial is not optimal in fitting local features of the function $f(\cdot)$. Increasing the order of the polynomial to improve the fit usually results in the numerical instability. Alternatively, a number of lower order polynomials may be fit locally. Typically, a piecewise linear approximation is sufficient. Examples of techniques for providing a piecewise polynomial (e.g., linear) approximation for $f(\cdot)$ will now be described.

Figure 7:
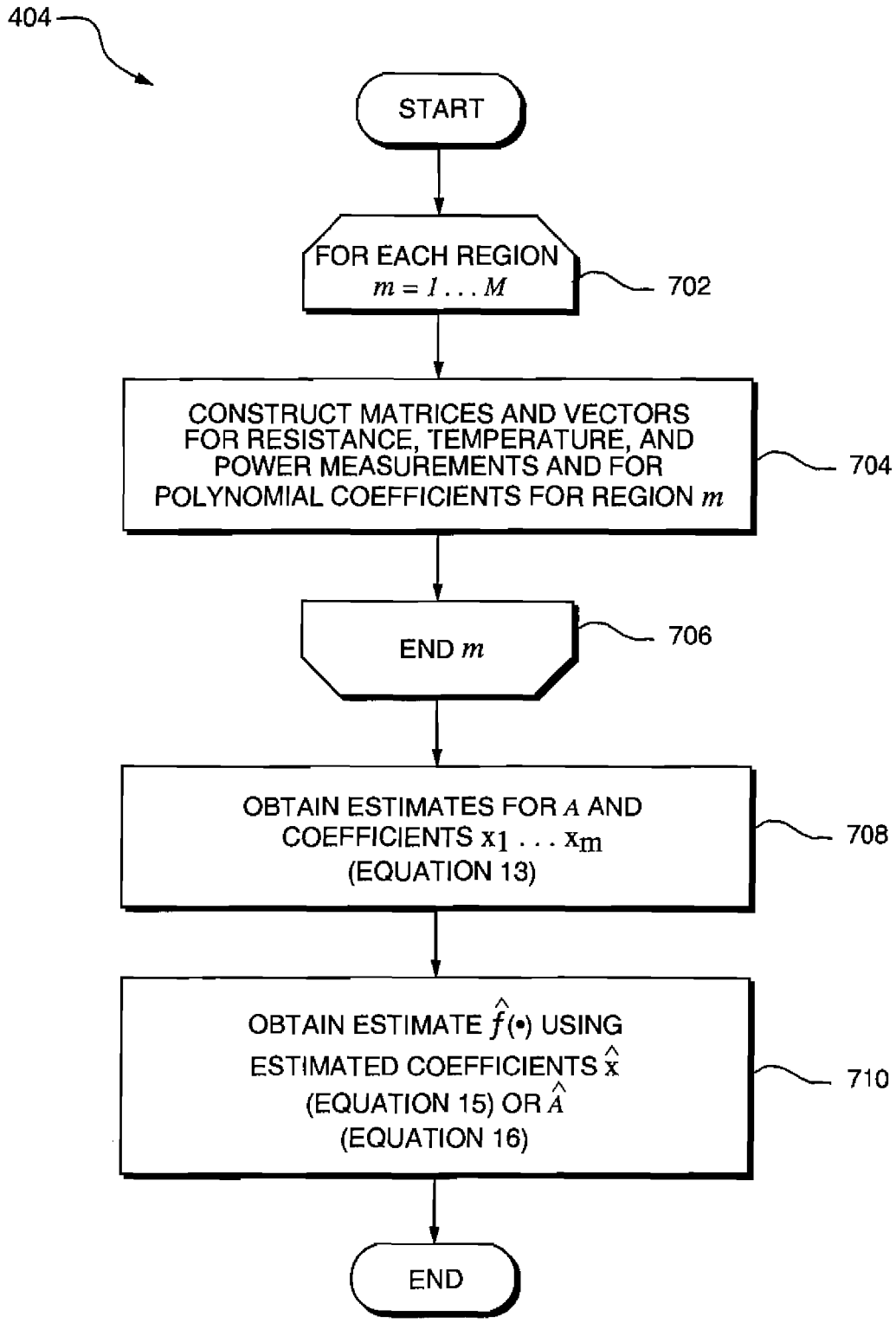

Let the domain of interest for the function $f(\cdot)$ be divided into M regions. Let $m=I(R_h)$ denote the index of the region that $R_h$ falls into. All the matrices and vectors defined in Equation 8 are now denoted with a subscript m. For example, the matrix $R_{hm}^p$ is constructed using only the resistance measurements $R_{hi}$ such that $I(R_h)$ is equal to m. Similarly, $P_m$ and $T_{sm}$ contain all the power and heat-sink temperature measurements that corresponds to the resistance measurements in $R_{hm}^p$. There are now M sets of polynomial coefficients, each denoted by the vector $X_m$. Referring to FIG. 7, a flowchart is shown of a method that may be used to implement step 404 of FIG. 4 (estimation of $f(\cdot)$) based on Equation 4). The method constructs the matrices and vectors $R_{hm}^p$, $T_{sm}$, $P_m$, and $x_m$ for each region m (steps 702-706).

The method then obtains estimates for A and the coefficients $x_1 \ldots x_m$ using Equation 13, which provides the solution to Equation 4 (step 708). An estimate $\hat{f}(\cdot)$ is obtained using the estimated coefficients $\hat{x}$ and Equation 15 (step 710). In Equation 13, the matrix D is defined by Equation 14, and W is a diagonal weight matrix constructed as $$W = \begin{bmatrix} W_1 & & \\ & \ddots & \\ & & W_M \end{bmatrix},$$

where $W_m$ is computed from Equation 10 for the region m. The function $\hat{f}(R_h)$ estimated by this method is given by Equation 15.

$$\begin{bmatrix} \hat{x}_1 \\ \vdots \\ \hat{x}_M \\ \hat{A} \end{bmatrix} = (D^T W D)^{-1} D^T W \begin{bmatrix} T_{s1} \\ \vdots \\ T_{sM} \end{bmatrix} \quad \text{Equation 13}$$

$$D = \begin{bmatrix} R_{h1}^p & & -P_1 \\ & \ddots & \vdots \\ & R_{hM}^p & -P_M \end{bmatrix} \quad \text{Equation 14}$$

$$\hat{f}(R_h) = \hat{x}_{I(R_h)p} R_h^p + \ldots + \hat{x}_{I(R_h)0} \quad \text{Equation 15}$$

Figure 8:
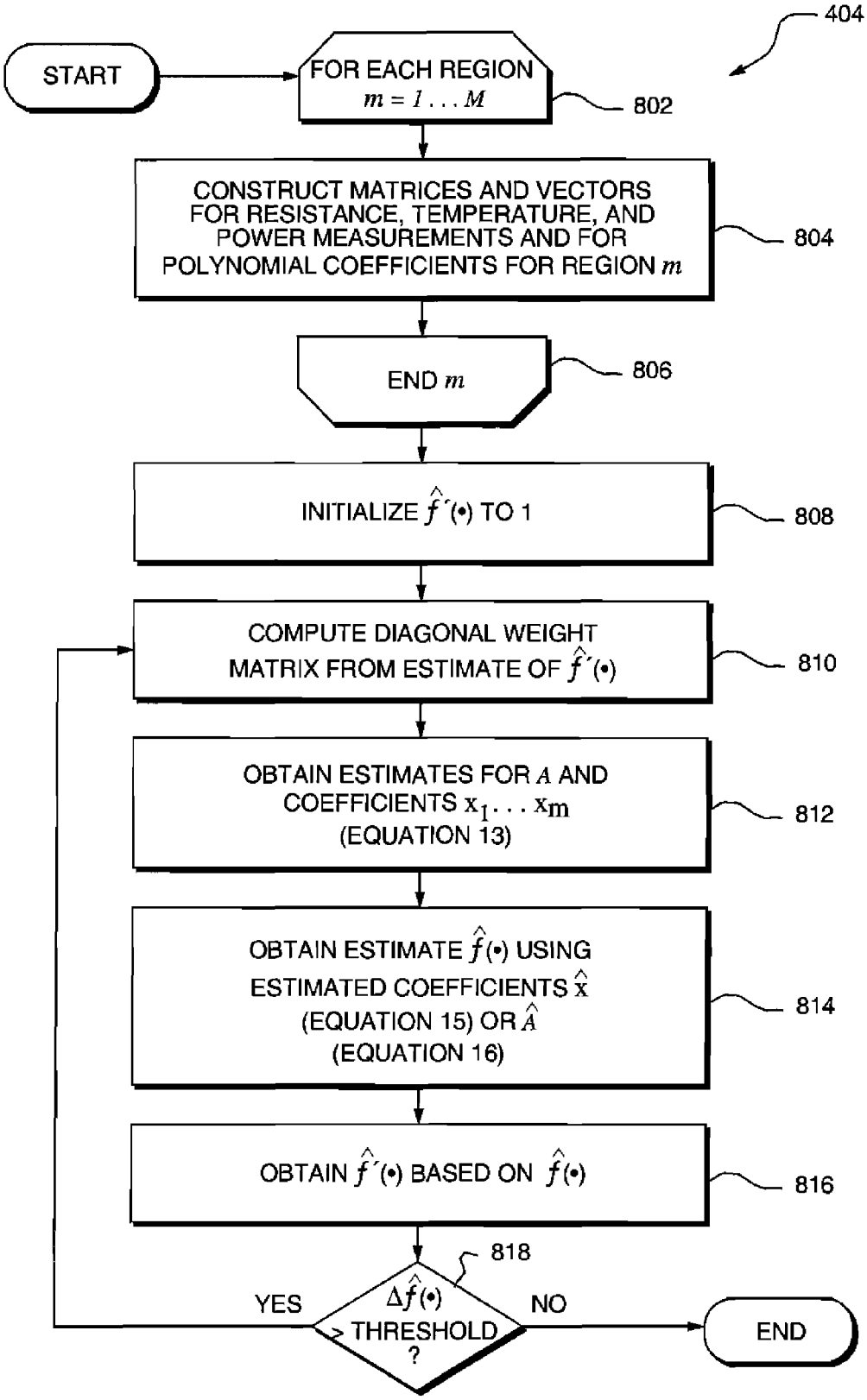

The iterative solution to Equation 6 may be performed in a fashion similar to that described above with respect to FIG. 6. More specifically, referring to FIG. 8, a flowchart is shown of a method that may be used to implement step 404 of FIG. 4 (estimation of $f(\cdot)$) based on Equation 6. The matrices and vectors are constructed in the same manner as described above with respect to steps 702-706 of FIG. 7 (FIG. 8, steps 802-806).

An estimate $\hat{f}'(\cdot)$ of the derivative of $f(\cdot)$ is initialized to one (step 808). The diagonal weight matrix W is constructed as $$W = \begin{bmatrix} W_1 & & \\ & \ddots & \\ & & W_M \end{bmatrix},$$

where $W_m$ is computed using the estimate of $\hat{f}'(\cdot)$ (Equation 12) for the region m (step 810). Estimates for A and the coefficients $x_1 \ldots x_m$ are obtained using Equation 13 (step 812). An estimate $\hat{f}(\cdot)$ is obtained using the estimated coefficients $\hat{x}_1 \ldots \hat{x}_m$ and Equation 15 (step 814). A new estimate $\hat{f}'(\cdot)$ is computed based on $\hat{f}(\cdot)$ (step 816).

Steps 810-816 may be repeated as many times as desired. For example, the current value of $\hat{f}(\cdot)$ may be compared to the value of $\hat{f}(\cdot)$ from the previous iteration of steps 810-816. If the difference is greater than some predetermined threshold value (step 818), steps 810-816 may be repeated. Otherwise, the method shown in FIG. 8 terminates. In this way, the estimate of $\hat{f}(\cdot)$ is refined until it converges on a final value to within the predetermined threshold tolerance.

The function estimated by this method will probably be discontinuous at the region boundaries because continuity constraints have not been imposed on the polynomial coefficients. It should be noted that the technique is not restricted to having non-overlapping regions. In the embodiment where the regions overlap, the estimated function is better behaved and has smaller discontinuities. In this case, a measurement has multiple region indices associated with it. Therefore a single measurement is replicated multiple times in the matrix D and the heat-sink temperature vector $T_s$.

The estimation of the temperature model parameter $\hat{A}$ simplifies the optimization consideration posed in Equation 4. The preliminary piece-wise polynomial fit may be refined by fitting a spline to minimize the error metric given by Equation 16. This may be performed, for example, in step 508 in FIG. 5, step 610 in FIG. 6, step 710 in FIG. 7, or step 814 in FIG. 8.

$$\hat{f}(\cdot) = \underset{f(\cdot)}{\operatorname{argmin}} \sum_i \frac{1}{\sigma_i^2} \left( f(R_{hi}) - T_{si} - \hat{A} P_i \right)^2, \quad \text{Equation 16}$$

Note that if Equation 16 is used to estimate $\hat{f}(\cdot)$, the estimated coefficients of the model $\hat{x}$ are discarded and only $\hat{A}$ is used.

A disadvantage of the piecewise polynomial approximation is that continuity between the different polynomial pieces estimated in Equation 13 is not guaranteed. The subsequent step given by Equation 16 of employing a spline to ensure continuity of $\hat{f}(\cdot)$ may be suboptimal as A is not jointly estimated in this step.

An optimal solution may be obtained by incorporating the continuity constraints directly in the joint estimation of A and $f(\cdot)$ by employing a spline model such as that described by M. Unser, "Splines—A perfect fit for signal and image processing," IEEE Signal Proc. Magazine 16, pp. 22-38, November 1999, given by Equation 17, where $B_m^P(\cdot | k_m, \ldots, k_{m+p})$ is the $m^{th}$ B-spline of order p for the knot sequence $k_1 \leqq k_2 \leqq \ldots \leqq k_{M+p}$.

$$f(R_h) = \sum_{m=1}^{M} x_m B_m^p(R_h) \quad \text{Equation 17}$$

Figure 9:
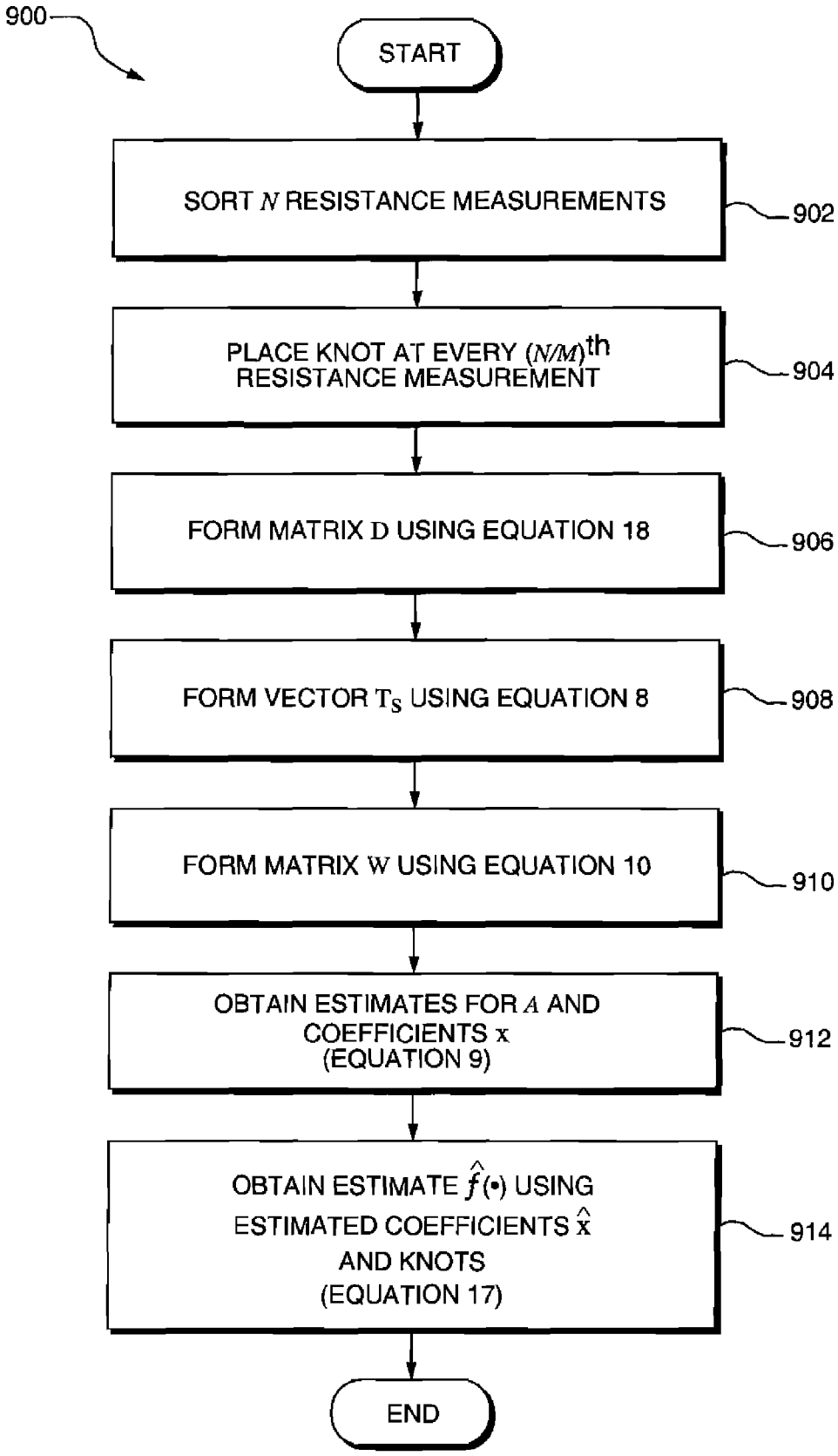

As shown by the method 900 of FIG. 9, the knot sequence may be chosen by sorting the N resistance measurements (step 902) and placing a knot at every $(N/M)^{th}$ resistance measurement (step 904). This procedure non-uniformly places the knots and automatically yields more definition where a large number of measurements are clustered. The estimate $\hat{f}(\cdot)$ may then be obtained using Equation 17 (step 914) using estimates for A and x obtained using Equation 9 (step 912), except that D and x are instead defined by Equation 18 (step 906), W is defined by Equation 10 (step 908), and $T_s$ is specified by Equation 8 (step 910).

Figure 10:
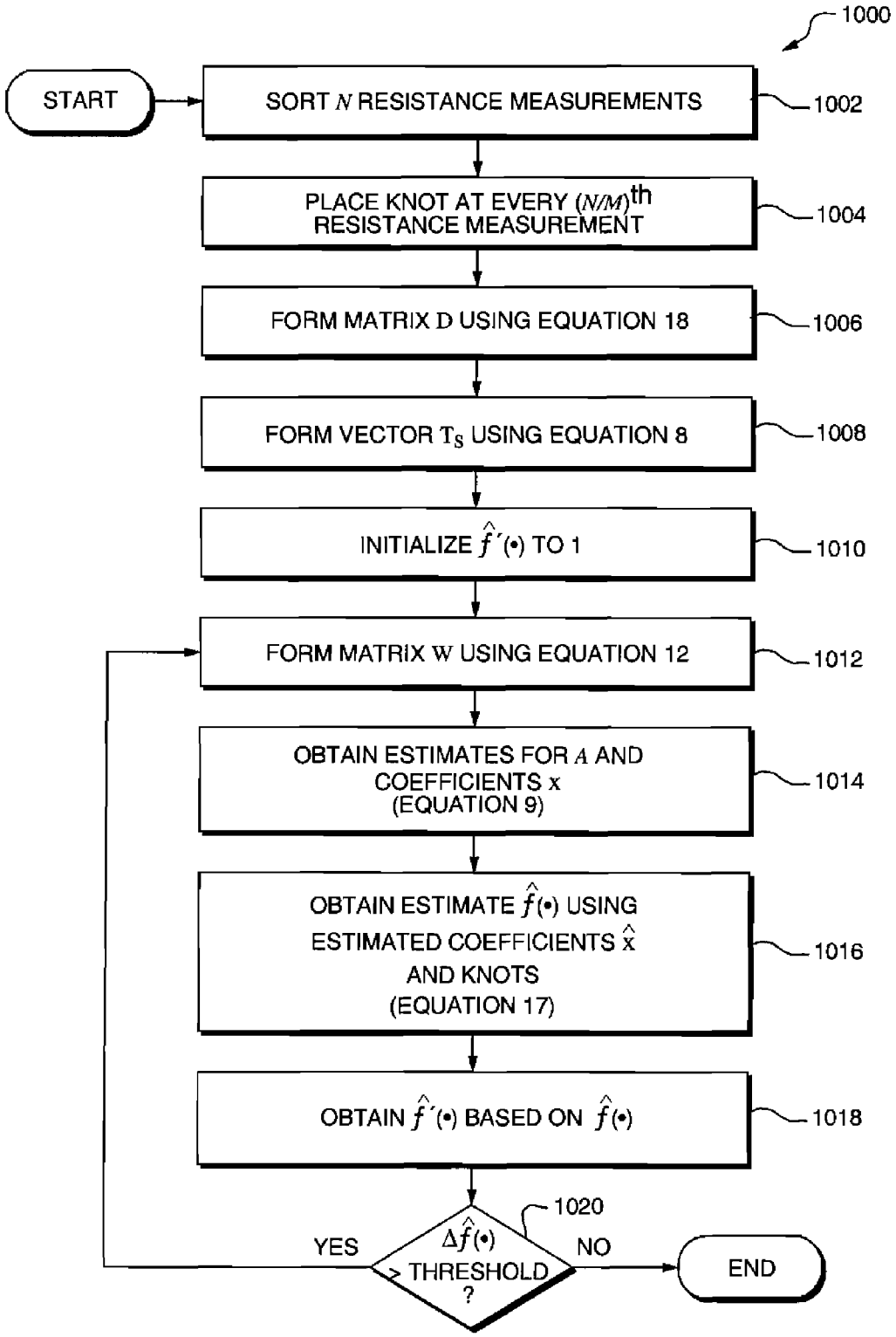

Referring to FIG. 10, an iterative version of the method 900 shown in FIG. 9 is illustrated. Steps 1002-1008 of method 1000 are performed in the same manner as steps 902-908 of the method 900 illustrated in FIG. 9. In step 1010, however, an estimate $\hat{f}'(\cdot)$ of the derivative of $f(\cdot)$ is initialized to one.

A loop is then entered in which the weight matrix W is constructed using Equation 12 (step 1012). Steps 1014 and 1016 are performed in the same manner as steps 912 and 914 of the method 900 illustrated in FIG. 9. A new estimate $\hat{f}'(\cdot)$ is computed based on $\hat{f}(\cdot)$ (step 1018). Note that the spline representation facilitates the computation of the derivative of $\hat{f}'(\cdot)$ for the weight matrix W in Equation 12 required for iterating the solution of Equation 9.

Steps 1012-1018 may be repeated as many times as desired. For example, the current value of $\hat{f}(\cdot)$ may be compared to the value of $\hat{f}(\cdot)$ from the previous iteration of steps 1012-1018. If the difference is greater than some predetermined threshold value (step 1020), steps 1012-1018 may be repeated. Otherwise, the method shown in FIG. 10 terminates. In this way, the estimate of $\hat{f}(\cdot)$ is refined until it converges on a final value to within the predetermined threshold tolerance.

$$D = \begin{bmatrix} B_1^p(R_{h1}) & \cdots & B_M^p(R_{h1}) & -P_1 \\ \vdots & \ddots & \vdots & \vdots \\ B_1^p(RN) & \cdots & B_M^p(R_{hN}) & -P_N \end{bmatrix}, x = \begin{bmatrix} x_1 \\ \vdots \\ x_M \end{bmatrix} \quad \text{Equation 18}$$

The joint estimation of $f(\cdot)$ and A tends to bias the temperature scale. The bias in the parameter estimates given by Equation 4 is difficult to compute directly since the estimated function $\hat{f}(\cdot)$ can take on an arbitrary shape. This can be simplified by assuming that our estimates of $\hat{f}(\cdot)$ and A differ from their true values by an unknown scalar s as given by Equation 19 and Equation 20. In Equation 20, $\overline{T}_s$ denotes the average heat-sink temperature in the measurements as given by Equation 21.

$$\hat{A} = sA \quad \text{Equation 19}$$

$$\hat{f}(R_h) = s(f(R_h) - \overline{T}_s) + \overline{T}_s \quad \text{Equation 20}$$

$$\overline{T}_s = \frac{1}{N}\sum_i T_{si} \quad \text{Equation 21}$$

The maximum likelihood estimate for s is given by Equation 22, where $\Delta T_{si}=T_{si}-\overline{T}_s$ denote the variations of the heat-sink temperature measurements from the mean heat-sink temperature. The closed form expression for $\hat{s}$is obtained by setting the derivative with respect to s of the cost function that is being minimized in Equation 22 equal to zero, as given by Equation 23.

$$\hat{s} = \underset{s}{\operatorname{argmin}} \sum_i \frac{1}{\sigma_i^2}(s[f(R_{hi}) - \overline{T}_s] - \Delta T_{si} - sAP_i)^2, \quad \text{Equation 22}$$

$$\hat{s} = \frac{\sum_i \frac{1}{\sigma_i^2}\Delta T_{si}(f(R_{hi}) - \overline{T}_s - AP_i)}{\sum_i \frac{1}{\sigma_i^2}(f(R_M) - \overline{T}_s - AP_i)^2}, \quad \text{Equation 23}$$

Let $n_i$, defined by Equation 24, denote the noise arising due to measurement noise in the triplet $\{R_{hi}, T_{si}, P_i\}$.

$$n_i = f(R_{hi}) - T_{si} - AP_i \quad \text{Equation 24}$$

Assume that $E[n_i]=0$ and $E[n_{ik}^2]=\sigma_i^2$, where $E[\cdot]=0$ is the expectation operator. Substituting Equation 24 into Equation 23 obtains Equation 25.

$$\hat{s} = \frac{\sum_i \frac{1}{\sigma_i^2}\Delta T_{si}(n_i + \Delta T_{si_i})}{\sum_i \frac{1}{\sigma_i^2}(n_i + \Delta T_{s_i})^2} = \frac{1}{1 + \frac{1}{\frac{1}{N}\sum_i \frac{\Delta T_{si}^2}{\sigma_i^2}}} \quad \text{Equation 25}$$

The last step in Equation 25 assumes the number of measurements N is large, such that $$\sum_i \frac{1}{\sigma_i^2}\Delta T_{si} n_i \approx 0$$

and $$\sum_i \frac{n_i}{\sigma_i^2} \approx N.$$

We interpret the quantity SNR (Equation 26) as the average signal-to-noise ratio. The signal in this case is $\Delta T_{si}$ because it carries the primary source of information for the temperature model.

$$SNR \equiv \frac{1}{N}\sum_i \frac{\Delta T_{si}^2}{\sigma_i^2} \quad \text{Equation 26}$$

The expected value of $\hat{A}$ is computed using Equation 25 as given by Equation 27. The bias in $\hat{A}$ is given by Equation 28.

$$E[\hat{A}] = E[\hat{s}]A = \frac{A}{1 + \frac{1}{SNR}} \quad \text{Equation 27}$$

$$E[\hat{A}] - A = \frac{-A}{1 + SNR} \quad \text{Equation 28}$$

The result of Equation 28 implies that as SNR→∞, $E[\hat{A}]\rightarrow A$ and the bias in the estimated value of A disappears. Conversely, as the SNR decreases, the values of $\hat{A}$ are increasingly biased lower. The reason for this phenomenon is directly related to the choice of the estimation criterion. As seen from Equation 4, A and $f(\cdot)$ are chosen such that the fitting error is minimized. The optimizer finds that it can lower the overall fitting error by choosing slightly lower values for A. This is because A amplifies the temperature, and by reducing the gain the fitting errors are reduced in magnitude. The amount by which the optimal value of A is lower than the true value depends on the spread of the heat-sink temperatures. For a large spread, any deviation from the true value results in a mismatch with the temperature model and drives up the fitting error. The biased parameters estimates are therefore accompanied by a biased estimate of the noise given by the fitting error. For small SNRs., the noise is underestimated as well. For example, in the extreme case of SNR=0, which occurs when $\Delta T_{si}=0$, ∀i, the fitting error becomes 0 for $\hat{A}=0$ and $\hat{f}(R_h)=\overline{T}_s$, $\forall R_h$.

Consider an alternative method of parameter estimation where the fitting error, instead of being minimized, is set equal to the expected noise. There are two problems with this alternative method. First, the amount of measurement noise may not be known. Second, even if the amount of measurement noise is known, the fitting error has an additional unknown component: the mismatch between the model for $f(\cdot)$ and the true $f(\cdot)$.

Given this uncertainty, in one embodiment, the bias in the estimated parameters is reduced by maximizing the average SNR as defined by Equation 26. In addition to minimizing the measurement noise variance, the variance of the heat-sink temperatures is maximized. Since the uniform distribution, among the class of uniform distributions, has the largest variance among all distributions, the maximum SNR for a given minimum and maximum heat-sink temperature is obtained by distributing the intermediate temperatures uniformly within the specified range.

All of the previous discussion has focused on a single on-time; i.e., the heating element is turned on for a fixed period of time at the end of which a single resistance measurement is taken. However, it may also be advantageous to make measurements using multiple on-times of varying duration. The reason is that for each distinct power measurement, it is desirable to wait for the thermal print head to come to thermal equilibrium to the control temperature before the measurement is made. These wait times can substantially increase the data acquisition time. On the other hand, the measurements for distinct on-times may be taken in one run; the heating element in this case is turned on and left in that state for the longest on-time that is desired. In step 212 of the method 200 shown in FIG. 2, instead of measuring a single resistance $R_{hi}$, a resistance is measured and recorded at discrete time instances corresponding to all of the desired on-times. If the longest on-time is short enough, the temperature rise for a Δt on-time can be accurately modeled by a single time constant τ as given by Equation 29.

$$T_h = T_s + A\left(1 - e^{-\frac{\Delta t}{\tau}}\right)P \qquad \text{Equation 29}$$

This increases the number of parameters to estimate by one as τ is now an additional unknown. Since the temperature model depends non-linearly on the time constant τ, a closed form solution to Equation 4 is no longer possible. However, Equation 29 may be linearized by performing a first order Taylor series expansion about the current estimate of τ ($\tau_0$), as shown in Equation 30.

$$1 - e^{-\frac{\Delta t}{\tau}} \approx 1 - e^{-\frac{\Delta t}{\tau_0}} - \frac{\tau - \tau_0}{\tau_0^2} e^{-\frac{\Delta t}{\tau_0}} \qquad \text{Equation 30}$$

Rewriting Equation 29 with the approximation of Equation 30 gives Equation 31.

$$T_h \approx T_s + A\left(1 - e^{-\frac{\Delta t}{\tau_0}} + \frac{e^{-\frac{\Delta t}{\tau_0}}}{\tau_0}\right)P - A\tau\frac{e^{-\frac{\Delta t}{\tau_0}}}{\tau_0^2}P \qquad \text{Equation 31}$$

If we let B=Aτ, then the solution to the global polynomial method is given by Equation 32, where D is given by Equation 33 and the vectors $P_A$ and $P_B$ are given by Equation 34.

$$\begin{bmatrix} \hat{x} \\ \hat{A} \\ \hat{B} \end{bmatrix} = (D^T W D)^{-1} D^T W T_s \qquad \text{Equation 32}$$

$$D = [R \quad -P_A \quad P_B] \qquad \text{Equation 33}$$

-continued $$P_A = \begin{bmatrix} \left(1 - e^{-\frac{\Delta t_1}{\tau_0}} + \frac{e^{-\frac{\Delta t_1}{\tau_0}}}{\tau_0}\right)P_1 \\ \vdots \\ \left(1 - e^{-\frac{\Delta t_N}{\tau_0}} + \frac{e^{-\frac{\Delta t_N}{\tau_0}}}{\tau_0}\right)P_N \end{bmatrix}, \qquad \text{Equation 34}$$

$$P_B = \begin{bmatrix} \frac{e^{-\frac{\Delta t_1}{\tau_0}}}{\tau_0^2}P_1 \\ \vdots \\ \frac{e^{-\frac{\Delta t_N}{\tau_0}}}{\tau_0^2}P_N \end{bmatrix}$$

Note that $\Delta t_i$ denotes the time power $P_i$ is applied to the print head element. The weight matrix W (Equation 10) and vector $T_s$. (Equation 8) are the same as defined for the global polynomial method.

An updated value of the time constant is obtained as given by Equation 35. The procedure may be iterated by recomputing the vectors $P_A$ and $P_B$ for the new value of τ until the estimates converge.

$$\tau = \frac{\hat{B}}{\hat{A}} \qquad \text{Equation 35}$$

The iterative version of the global polynomial method as well as the solution to the piece-wise polynomial and the spline method follows along the same lines as presented above and should be straightforward for someone having ordinary skill in the art to derive.

Now consider the case when the on-times Δt are very short compared to the time constant τ of the print head. Therefore, Δt/τ is small. As a result, $$1 - e^{\frac{-\Delta t}{\tau}}$$

may be approximated by Δt/τ. In this case, Equation 29 is equivalent to Equation 2; with substituted for A/τ, and with PΔt substituted for P. Therefore, Equation 29 may be solved by using the techniques applied above to Equation 2, but with a new variable B=A/τ substituted for A, and with PΔt substituted for P.

Another alternative is to employ a different value of A for each of the different on-times. The temperature model is then given by Equation 36.

$$T_h = T_s + A_{\Delta t}P. \qquad \text{Equation 36}$$

Since the model is linear in the different $A_{\Delta t}$ parameters, the solutions presented above with respect to Equation 7-Equation 18 are directly applicable with only minor modifications, which will be apparent to those having ordinary skill in the art. For a limited number of on-times, the increase in the number of parameters is modest as compared to the model of Equation 29.

Figure 18:
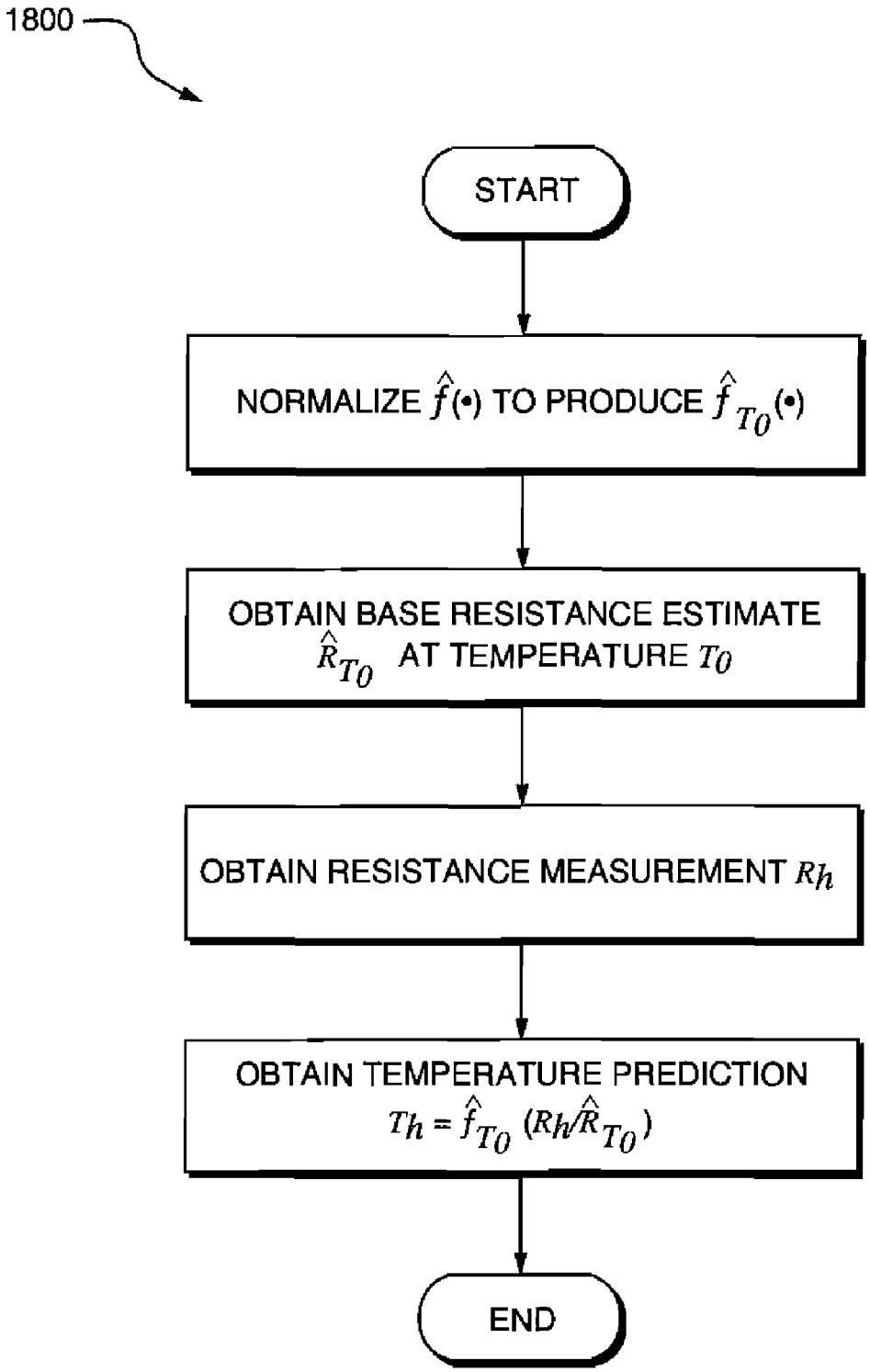
FIG. 18 is a flowchart of a method for using an estimated resistance-temperature function to predict a temperature of a thermal print head element based on its resistance according to one embodiment of the present invention.

Having described various techniques for producing the estimate $\hat{f}(\cdot)$ examples of techniques will now be described for using the estimate $\hat{f}(\cdot)$, with reference to the method 1800 of FIG. 18. Recall that the estimate $\hat{f}(\cdot)$ for a particular print head element relates the absolute resistance of the element to its absolute temperature. Therefore, $\hat{f}(\cdot)$ is not generally applicable to other print head elements that have a different base resistance (defined as the resistance of the element at some predetermined fixed temperature). If, however, the print head element for which $\hat{f}(\cdot)$ was generated is made from the same material as another print head element, the relative change in the resistances of the two print head elements with respect to their base resistances will be the same for a unit change in temperature.

Therefore, in one embodiment we define $\hat{f}_{T_0}=\hat{f}(R/R_{T_0})$, which is a normalized version of $\hat{f}(\cdot)$ (step 1802). $R_{T_0}$ is the print head element resistance at temperature $T_0$. $\hat{f}_{T_0}$ may be used to estimate the temperature of any print head element made from the same material as the print head element used to estimate $\hat{f}(\cdot)$, as follows.

An estimate $\hat{R}_{T_0}$ is obtained of the base resistance of the print head element at temperature $T_0$ (step 1804). The current resistance $R_h$ of the print head element is measured (step 1806), and the temperature $T_h$ of the print head element is estimated using $T_h=\hat{f}_{T_0}(R_h/\hat{R}_{T_0})$ (step 1808).

Measurement of the base resistance $\hat{R}_{T_0}$, however, poses a problem. Typically, the print head is kept in an oven at temperature $T_0$ and a small amount of current is applied to the element to measure its resistance $\hat{R}_{T_0}$. If the current applied is very small, there will be no appreciable rise in the element's temperature from the equilibrium temperature $T_0$ and the estimate will be reasonably accurate.

Figure 19:
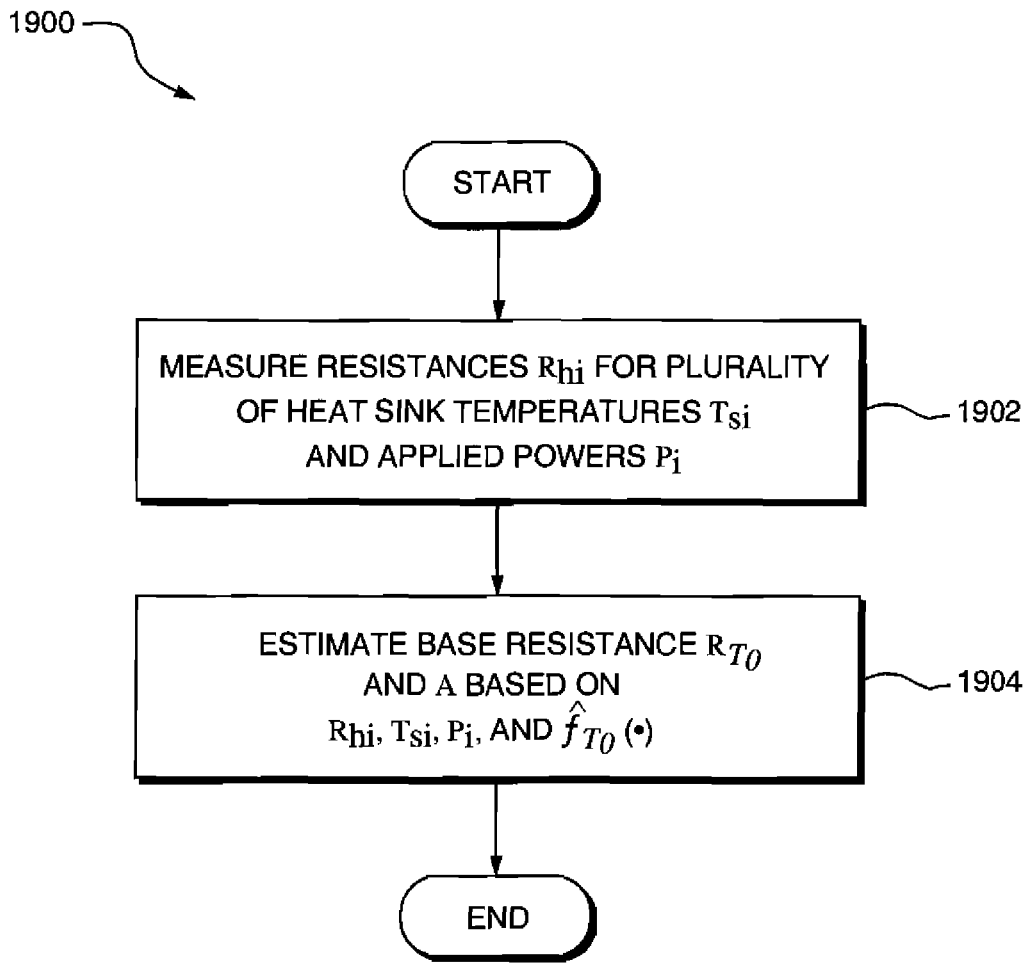
FIG. 19 is a flowchart of a method for estimating a base resistance of a thermal print head element for use in predicting a temperature of the thermal print head element according to one embodiment of the present invention.

If, however, the current is not small or if more accuracy is desired, the method 1900 illustrated in FIG. 19 may be used. The resistance $R_{hi}$ of the print head element is measured for various combinations of heat sink temperatures $T_{si}$ and applied powers $P_i$, where i ranges from 1 to N, and wherein $N\geqq 2$ (step 1902). The base resistance $\hat{R}_{T_0}$ and A are estimated simultaneously (step 1904). $\hat{R}_{T_0}$ and $\hat{A}$ may, for example, be estimated simultaneously using Equation 37.

$$\left[\hat{R}_{T_0}, \hat{A}\right] = \underset{R_{T_0},A}{\operatorname{argmin}} \sum_{i=1}^{N} \left(\hat{f}_{T_0}(R_{hi}/R_{T_0}) - T_{si} - AP_i\right)^2 \qquad \text{Equation 37}$$

If, however, $\hat{R}_{T_0}$ is known or estimated independently as described above, $\hat{A}$ may be estimated using Equation 38, in which case $\hat{R}_{T_0}$ need not be estimated in step 1904.

$$\hat{A} = \frac{\sum_{i=1}^{N} P_i\left(\hat{f}_{T_o}\left(R_{hi}/\hat{R}_{T_o}\right) - T_{si}\right)}{\sum_{i=1}^{N} P_i^2} \qquad \text{Equation 38}$$

The techniques disclosed above may be used to eliminate or reduce print head element to print head element variability, or print head to print head variability. For example, an estimate of A may be obtained for a first print head element, and a separate estimate of A may be obtained for a second print head element. The input energy provided to the first and second print head elements may be adjusted based on a function of the first and second estimates to reduce or eliminate variability between the print head elements. For example, the energies may be adjusted based on a ratio of the first and second estimates.

Similarly, a first plurality of estimates of A may be obtained for a first plurality of print head elements. The first plurality of estimates may be averaged to obtain a first estimate of A. A second plurality of estimates of A may be obtained for a second plurality of print head elements. The second plurality of estimates may be averaged to obtain a second estimate of A. The input energy provided to the first thermal print head element and the input energy provided to the second thermal print head element may be adjusted based on a function of the first and second averages to reduce or eliminate variability between the print head elements. In either case, the energy may, for example, be adjusted by adjusting the input power and/or the on-time of the thermal print head elements. Those having ordinary skill in the art will appreciate how to apply similar techniques to reduce or eliminate variability between print heads rather than print head elements.

Figure 11A:
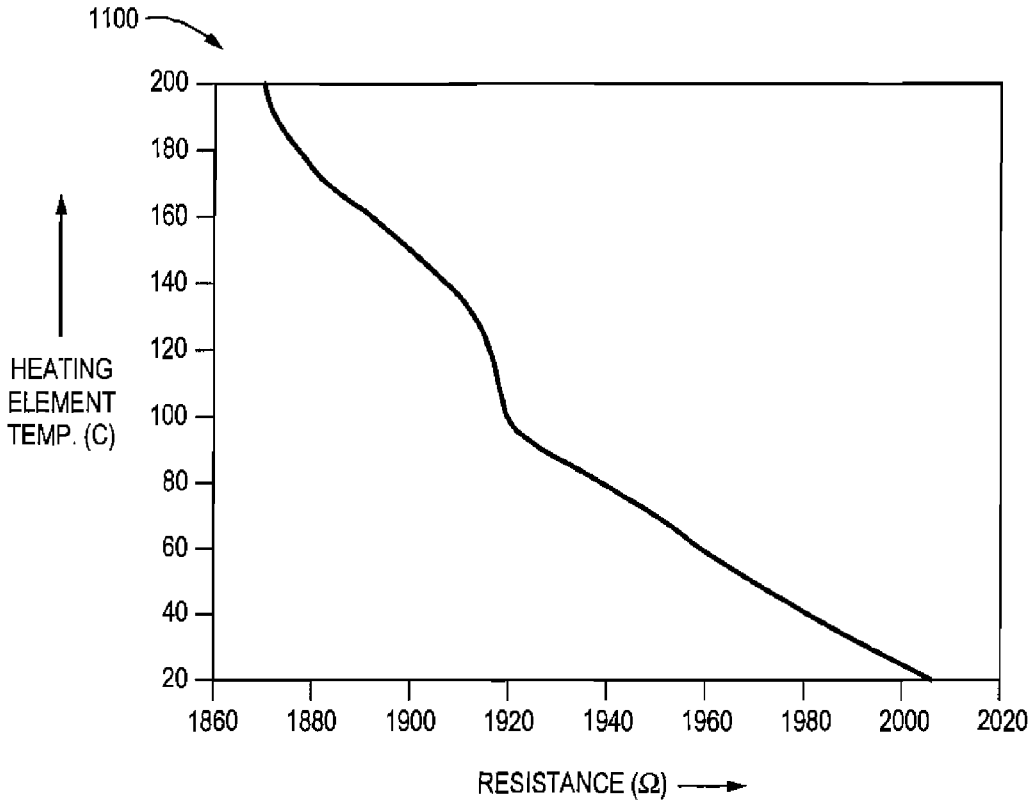
FIG. 11A shows the ground truth temperature vs. resistance function for a heating element used to generate synthetic data according to one embodiment of the present invention.
Figure 11B:
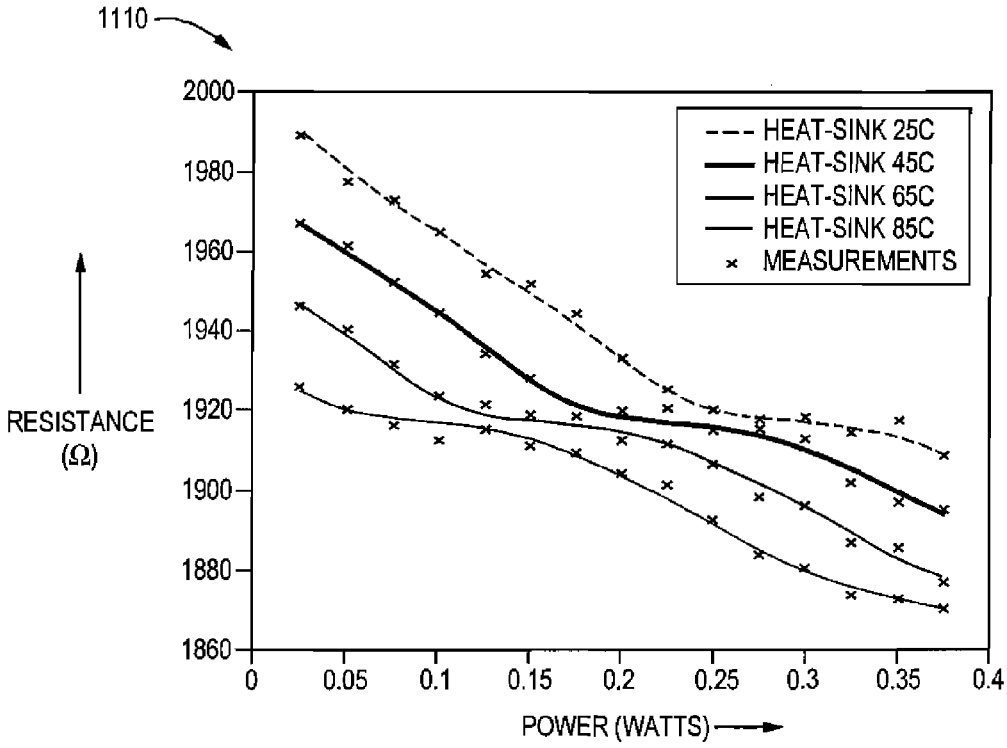
FIG. 11B shows resistance measurements made at different heat-sink temperatures and applied powers according to one embodiment of the present invention.

Consider first a synthetic example in which we have access to the true model parameters, so that we can assess the estimation accuracy of the different techniques disclosed herein. FIG. 11A shows the ground truth temperature vs. resistance function for the heating element that is used to generate the synthetic data. FIG. 11B shows the resistance measurements made at different heat-sink temperatures and applied powers. We used the temperature model of Equation 2 with A=300 C/Watts and $f(\cdot)$ as in FIG. 11A to compute the true resistance of the heating elements. The measurements are shown as "crosses" taken at 15 different power levels and 4 different heat-sink temperatures. Gaussian noise of standard deviation 2 Ω was added to the true resistance to obtain the final measurements. No noise was added to the measurements of power and heat-sink temperature. The average SNR for this data set is 21.1. From Equation 27, we obtain $E[\hat{A}]=286.42$ (a bias of 13.57 C/Watts in $\hat{A}$) if the shape of the estimated function is the same as the ground truth.

Figure 12:
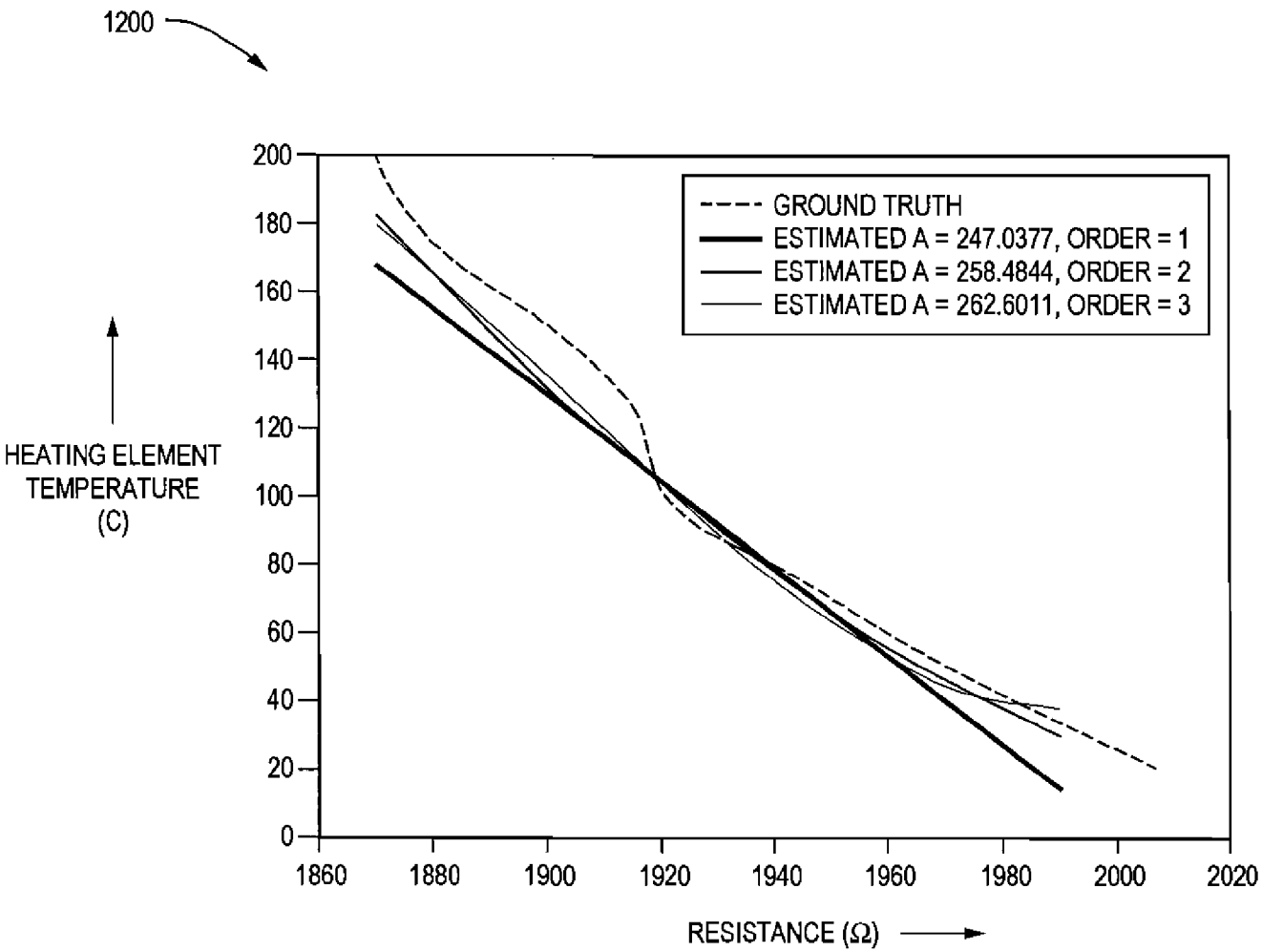
FIG. 12 shows an estimated resistance-temperature function using different order polynomials according to one embodiment of the present invention.

FIG. 12 shows the estimated function $\hat{f}(\cdot)$, using different order polynomials according to Equation 7. A single iteration of Equation 9 was performed with the weight matrix W set to identity (i.e., the noise was assumed to be identically distributed for all samples). We did not iterate on the solution by computing a new weighting matrix based on the derivative of the estimated function. As shown in FIG. 12, the polynomial model is not a very good fit to the local features of the ground truth function and as such the estimate is not very accurate even for high order polynomials. Furthermore, the estimate of A is biased lower from the true value of 300 in all the cases, although the bias decreases somewhat for the higher order polynomials.

Figure 13A:
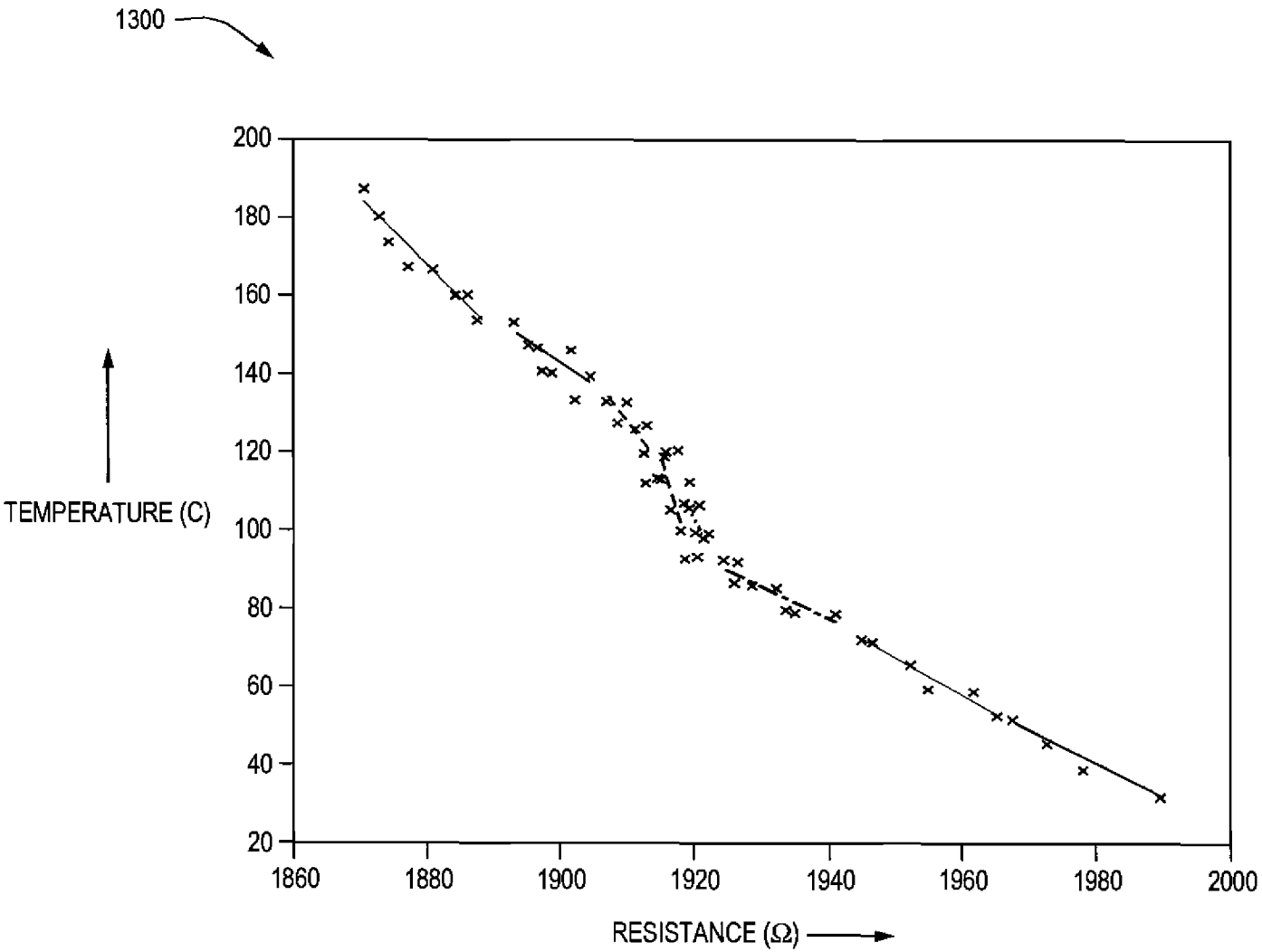
FIG. 13 shows experimental results obtained using piecewise polynomial approximation techniques according to one embodiment of the present invention.
Figure 13B:
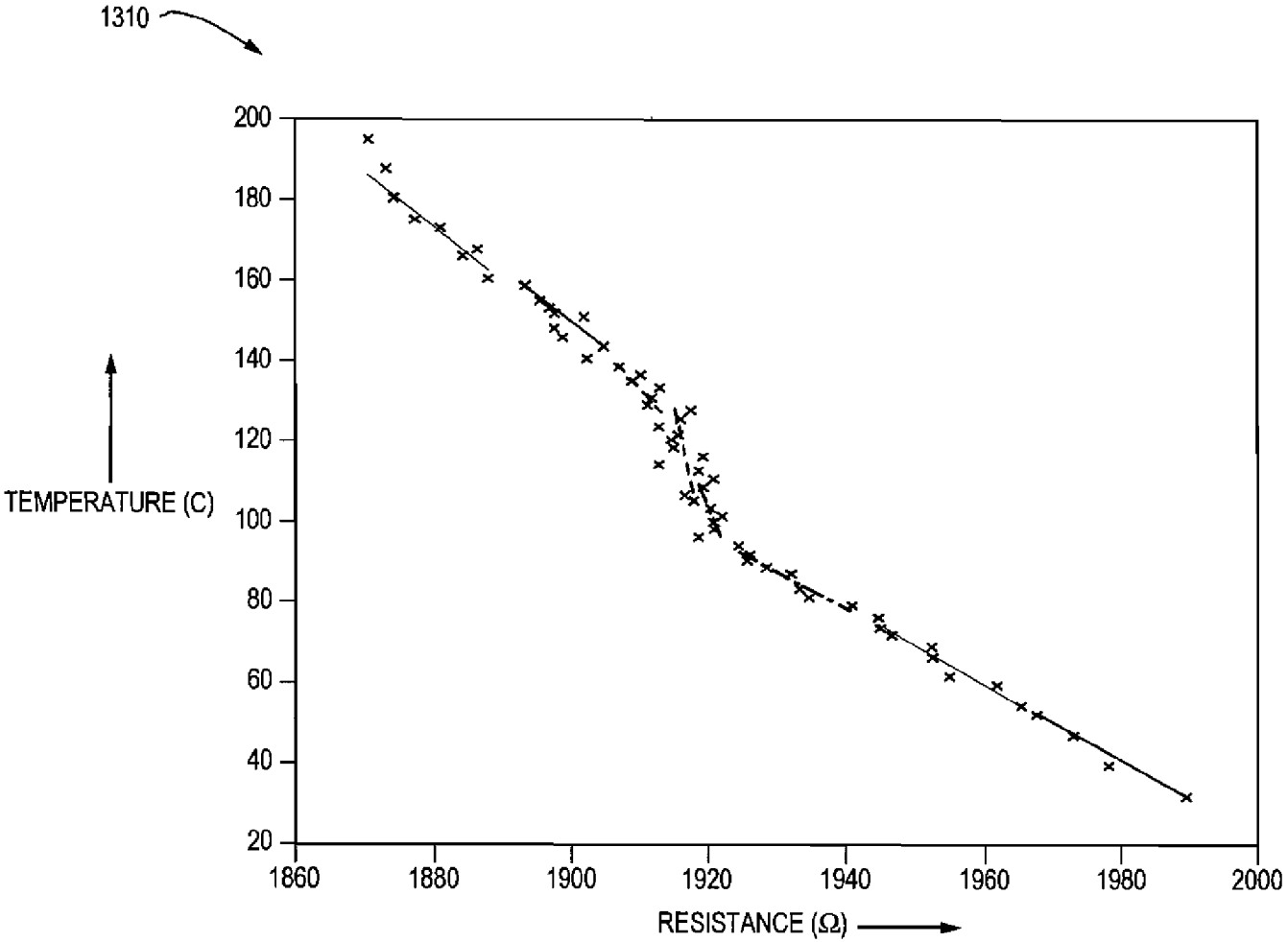

FIG. 13 shows the results obtained for the techniques described above with respect to Equation 13-Equation 16, for the synthetic data of FIG. 11. Eight non-overlapping regions were chosen such that each region had the same number of samples. Choosing the regions in this manner has the advantage that it automatically provides more definition or a higher resolution estimate for the unknown function in regions where there are more resistance measurements. A first order polynomial is chosen to fit the data in each of the regions. FIG. 13A shows the estimated function after the first iteration in which we assumed the weighting matrix W to be identity. FIG. 13B shows the result after the second iteration in which the weighting matrix is chosen as in Equation 12 based on the derivative of the function estimated in FIG. 13A.

In the first iteration of the solution given by Equation 13 (shown in FIG. 13A) the weight matrix W is set to identity since we do not have an initial estimate of $f(\cdot)$. In this case, A is estimated to be 273.56, which is biased quite a bit lower than the true value of 300. With this value of $\hat{A}$, a second order spline is fitted to the data using Equation 16. The derivative of this spline fit is used to obtain a new weight matrix W, which is used again in Equation 13 to obtain the estimate shown in FIG. 13B. It is seen that the local high slope region is better approximated by the fit in FIG. 13B as compared to FIG. 13A. Previously, the optimizer was reluctant to increase the slope of the fit in the high slope region as this would have increased the noise considerably in this region as compared to the rest of the curve. However, the new weight matrix selectively deemphasizes the noise in this region and allows the optimizer to increase the slope of the fit to accurately reproduce the local feature. The bias in the estimated value of $\hat{A}$=294.34 is also reduced, which is now much closer to the true value of 300.

Figure 14:
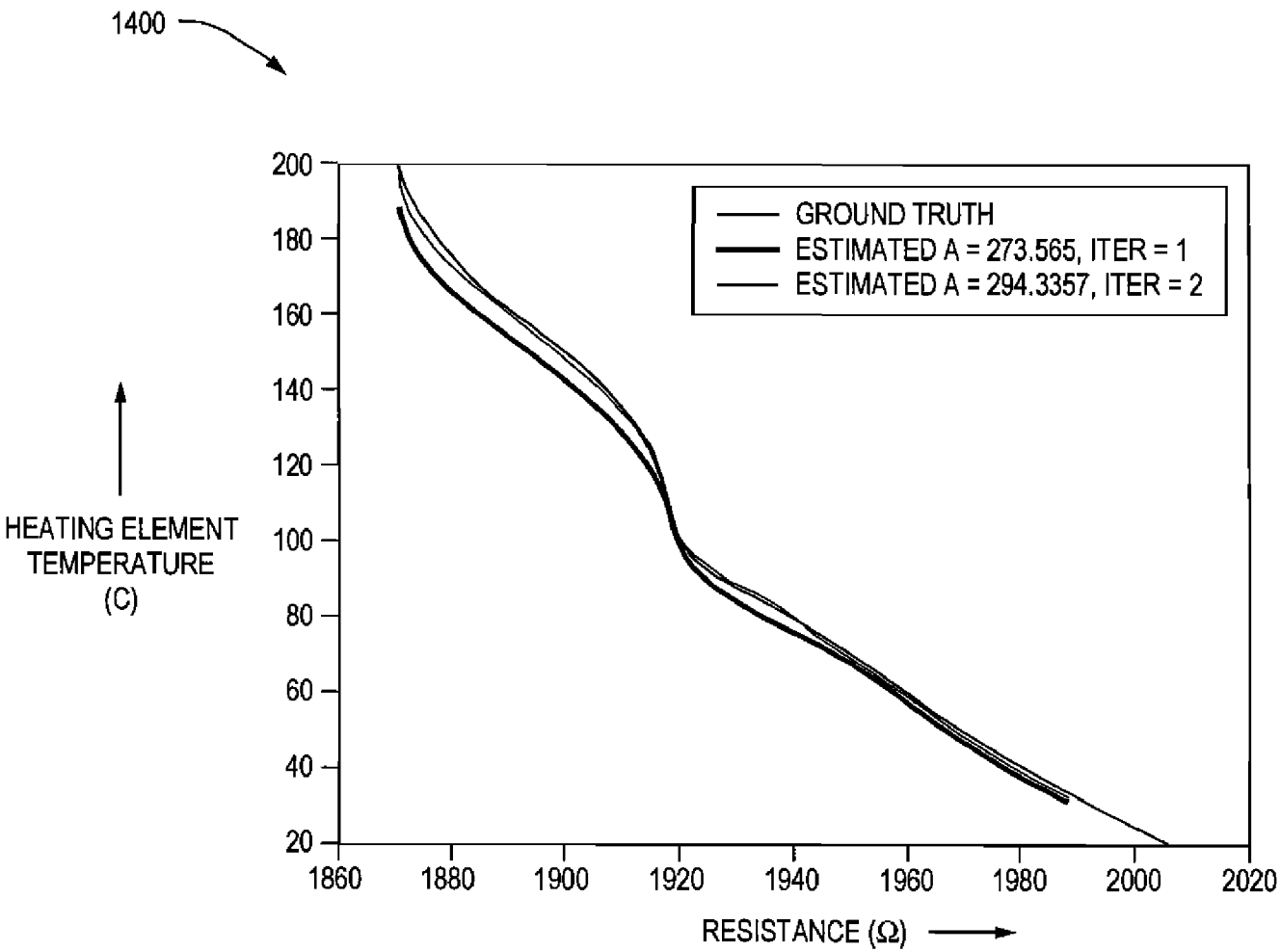
FIG. 14 compares spline fits to the ground truth when the spline fits are used to improve the results of polynomial approximations according to one embodiment of the present invention.

FIG. 14 compares the spline fits obtained in iterations 1 and 2 to the ground truth when the spline is used as a post-process correction, as described above with respect to Equation 16. Once the value of A is estimated, the thermal model of Equation 2 is utilized to associate a temperature with each measured resistance. A second order spline is then fitted to the resistance temperature pairs to obtain the final estimate. It is seen that the estimate obtained after the second iteration of the piece-wise linear fit is very accurate and the bias in $\hat{A}$ of 5.66 C/Watts is lower than the estimated bias of 13.57.

Figure 15:
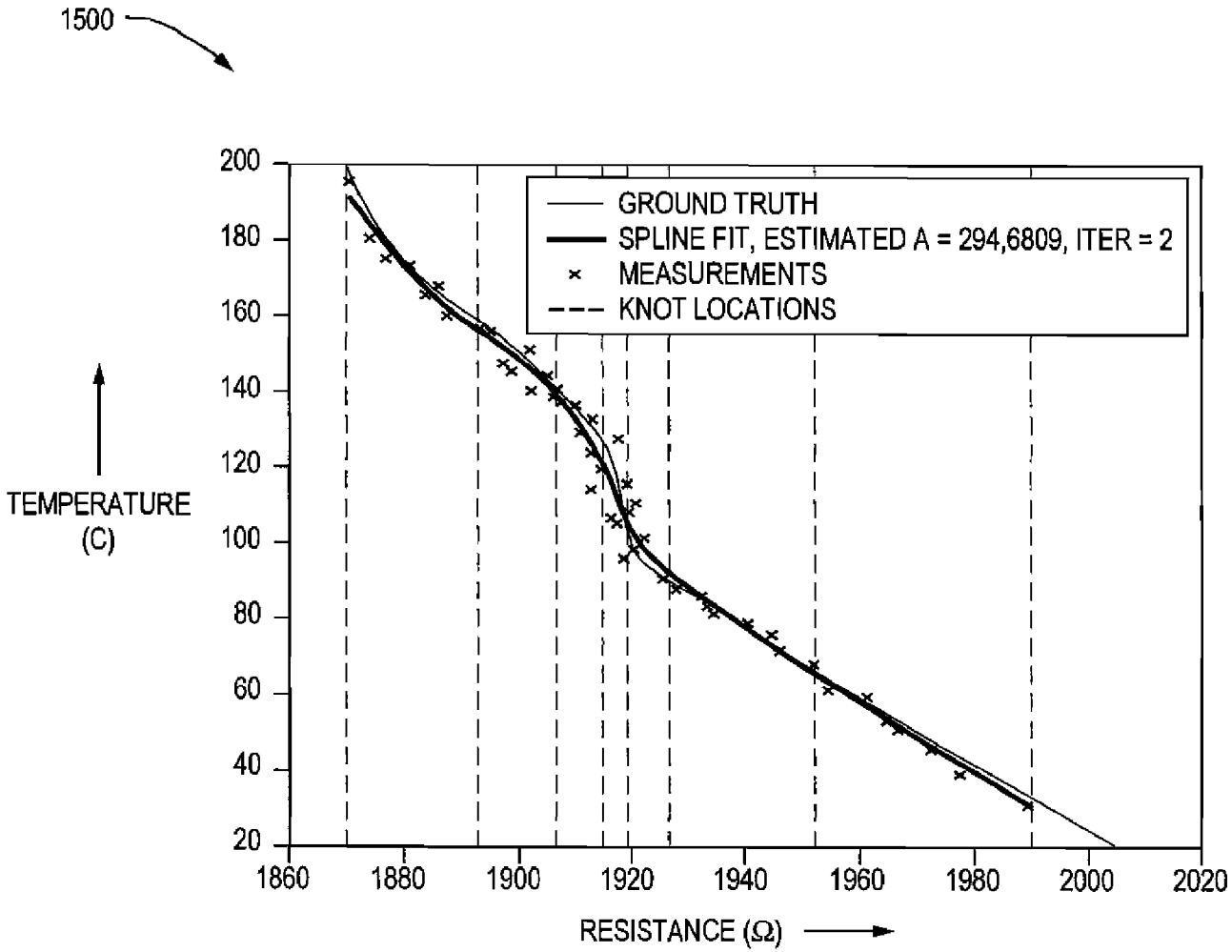
FIG. 15 shows an estimate resistance-temperature function for a spline model according to one embodiment of the present invention.

FIG. 15 shows the estimated resistance vs. temperature function for the spline model described above with respect to Equation 17-Equation 18. A second order spline with 8 knots was employed for the fit to enable direct comparison to the estimate obtained using the piece-wise polynomial method shown in FIG. 14. The eight knots were chosen by sorting the measurements and picking out every $(N/8)^{th}$ sample. The knot locations determined from the measurements are shown as vertical dashed lines. It is seen that more knots are automatically placed in regions where the resistance measurements are clustered. The estimated $\hat{A}$=294.68 is slightly closer to the ground truth value of 300 than the value obtained using the piece-wise polynomial method.

Figure 16A:
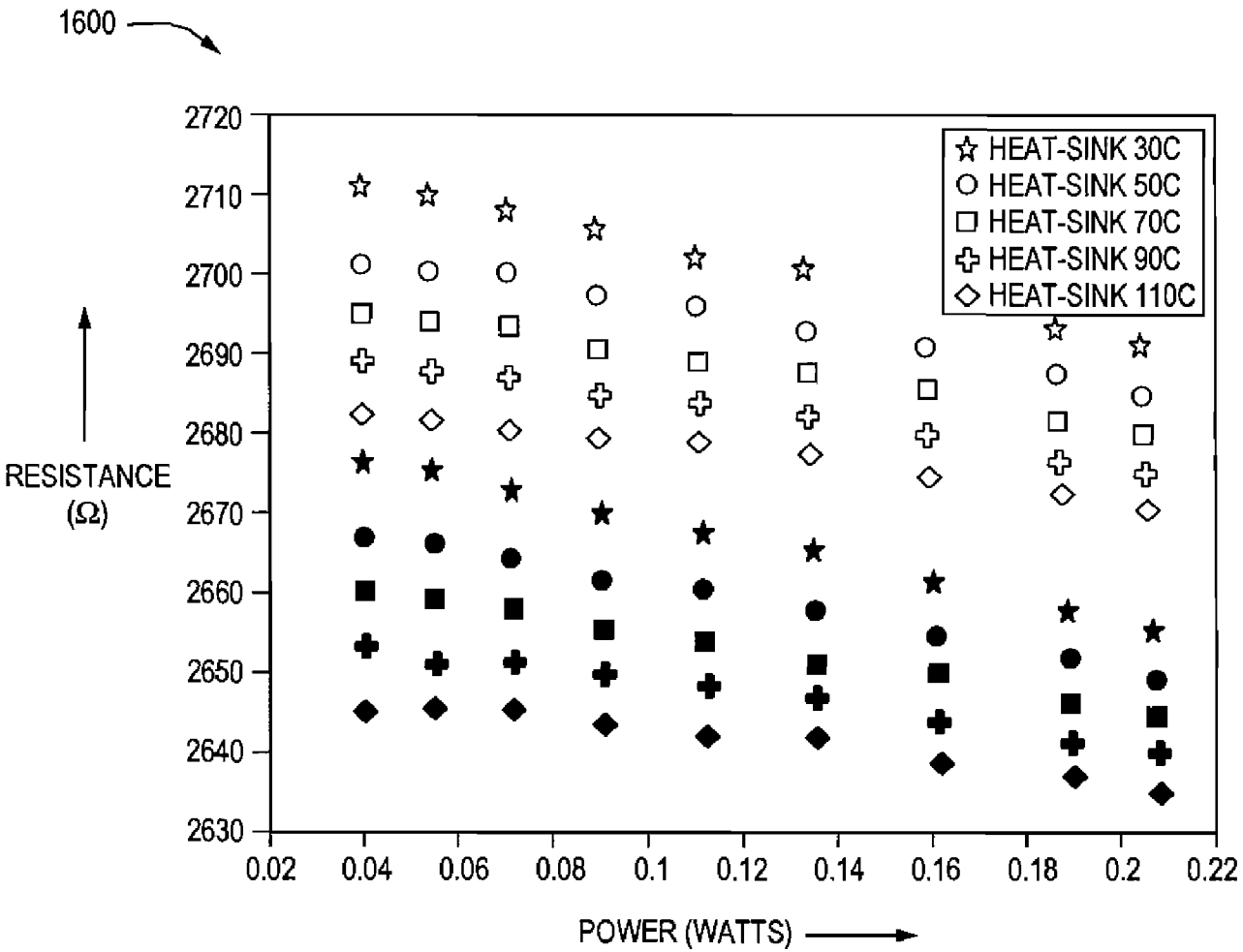
FIG. 16A shows data collected on a particular thermal print head according to one embodiment of the present invention.
Figure 16B:
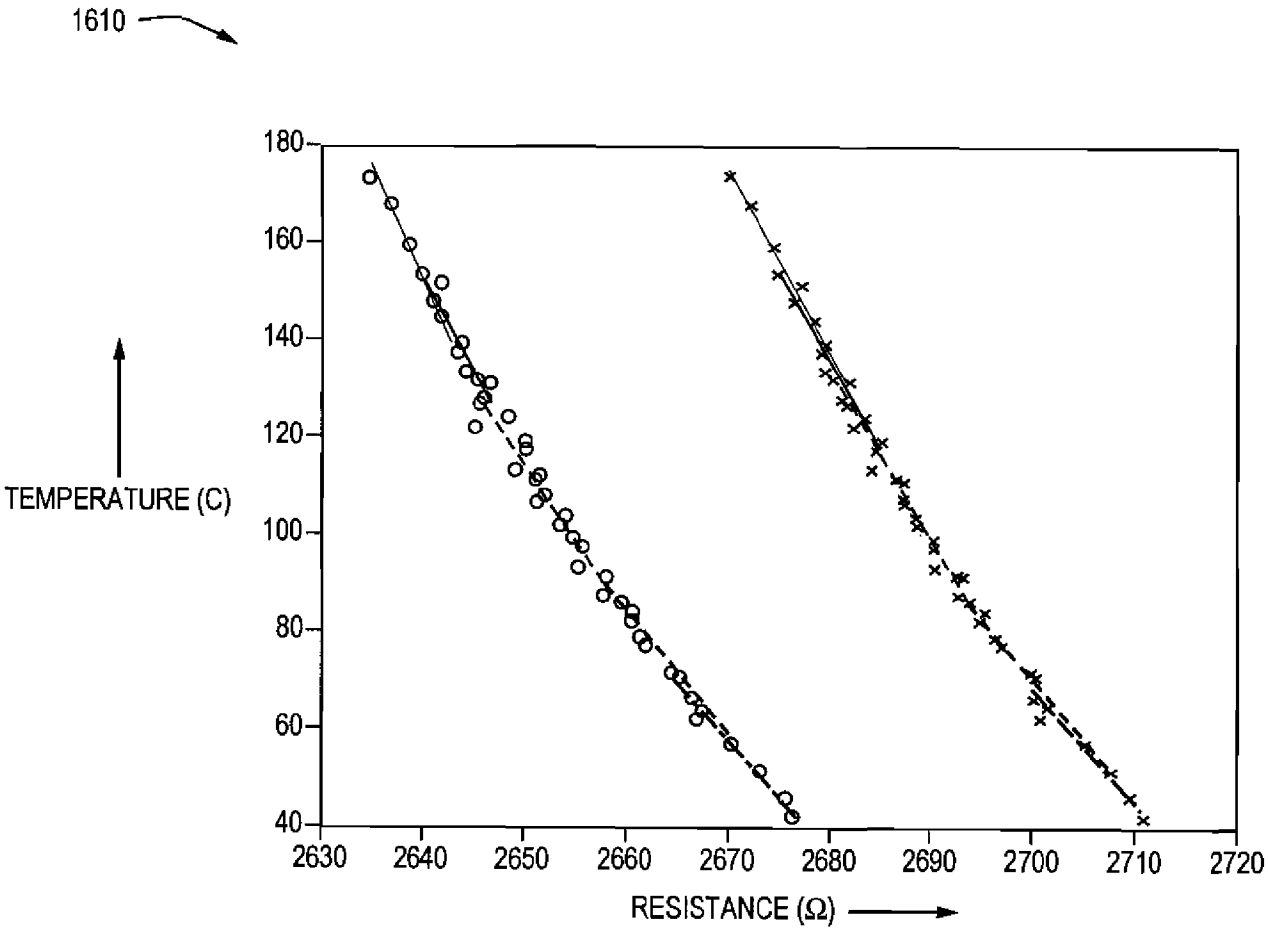
FIG. 16B shows the fits for two heating elements using a piecewise linear model according to one embodiment of the present invention.

FIG. 16A shows the data collected on a Toshiba thermal print head with 9 different power levels and 5 different heat-sink temperatures. The true values of A, $f(\cdot)$, and the noise standard deviation $\sigma_i$ are not known for this data set. The "crosses" and "circles" correspond to two different heating elements that are 64 elements apart. FIG. 16B shows the fits for the two heating elements using the piece-wise linear model for $f(\cdot)$. Four regions were chosen by sorting and separating the measured resistances into four groups. There was a 75% overlap between the regions. The estimated A for the two elements are $\hat{A}_1$=310.05 and $\hat{A}_{64}$=305.44. The estimated average temperature noise $$\sqrt{\frac{1}{N}\sum_i \sigma_i^2}$$

was approximately 2.5° C. The gives an SNR of approximately 130 and a bias of 1% in $\hat{A}$.

Figure 17A:
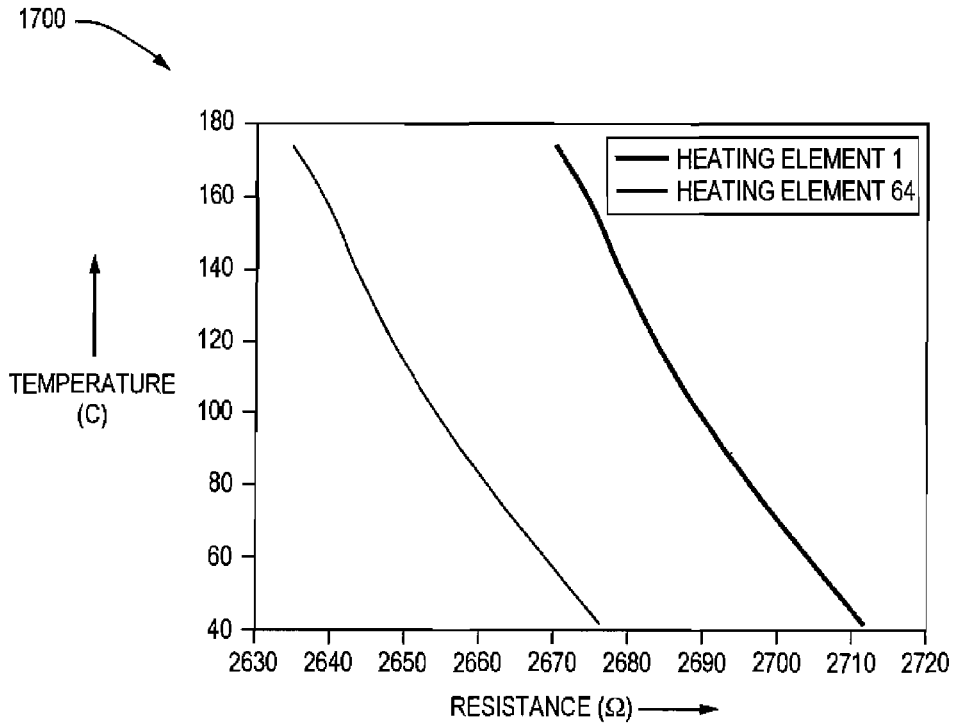
FIG. 17A shows a second order spline fit to resistance and reconstructed temperature sample pairs of FIG. 16B according to one embodiment of the present invention.
Figure 17B:
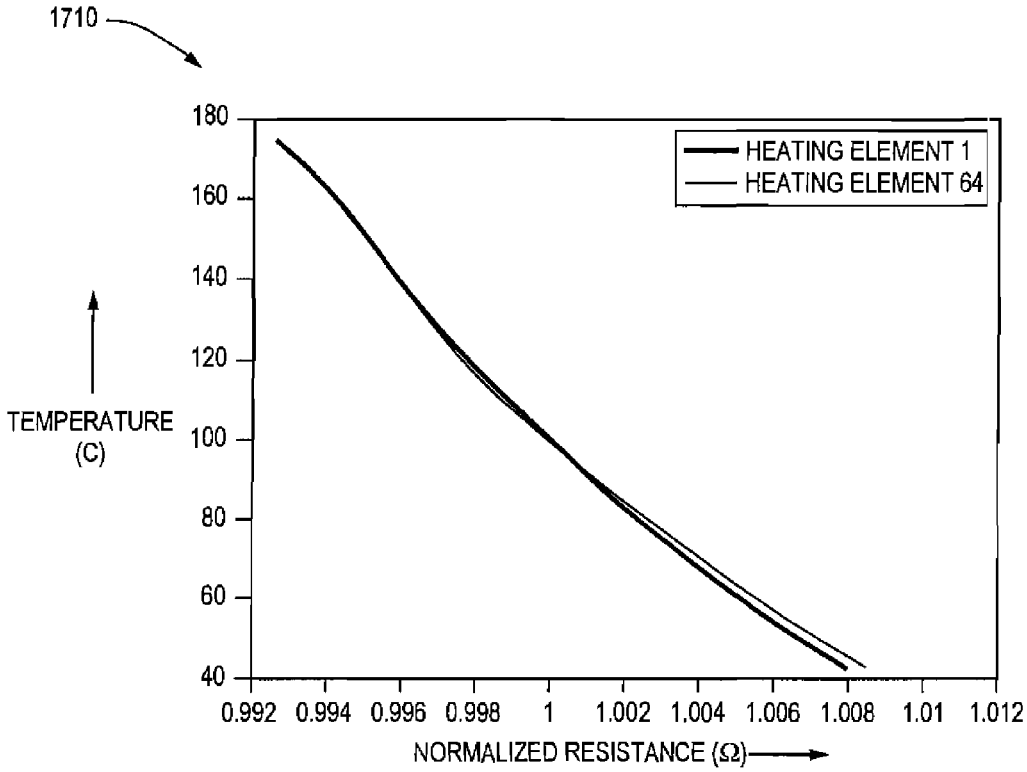
FIG. 17B shows an approximated resistance-temperature function as a function of normalized resistance according to one embodiment of the present invention.

FIG. 17A shows a second order spline fit to resistance and reconstructed temperature sample pairs of FIG. 16B. We see that these functions differ on the predicted temperature based on the absolute measured resistance. However, if the material properties are the same for the heating elements 1 and 64, the functions should agree on the change in resistance for a unit change in temperature. FIG. 17B shows $\hat{f}(\cdot)$ as a function of normalized resistance where 100° C. is chosen as the normalization point. It is seen that there is good agreement between the two estimates and the differences are on the order of the noise.

It has been shown that the simultaneous estimation of the temperature scale and resistance-temperature mapping is biased for the MLE. The bias may be reduced by lowering the measurement noise and/or increasing the range of the heat-sink temperatures for the resistance measurements. The piece-wise polynomial or the spline method may be used to reduce the model mismatch and bias since it can conform to any local feature of the resistance-temperature mapping. The model-based approach successfully estimates this mapping for temperatures much higher than the maximum heat-sink temperature used in the measurements.

A parametric model for the resistance change with temperature derived from the underlying physics of semiconductors (N. W. Ashcroft and N. D. Mermin, Solid State Physics, Saunders College Publishing, 1976) may be used for $f(\cdot)$. If the model accurately describes the heating elements material characteristics, it has the advantage of reducing the number of parameters that need to be estimated. Consequently, fewer measurements will be required to achieve the same accuracy as that of the non-parametric methods.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

What is claimed is:

1. A computer-implemented method for identifying an estimate $\hat{f}(\cdot)$ of a function $T_h=f(R_h)$ relating resistance $R_h$ of a thermal print head element in a thermal print head of a thermal printer to temperature $T_h$ of the thermal print head element, the method comprising:

(A) selecting a plurality N of initial temperatures $T_{si}$;

(B) heating an insulated chamber containing the thermal print head to the plurality of initial temperatures $T_{si}$;

(C) providing the thermal print head element with a plurality N of input powers $P_i$;

(D) measuring a plurality N of resistances $R_{hi}$ resulting from application of the plurality of input powers $P_i$; and (E) identifying the estimate $\hat{f}(\cdot)$ based on the plurality of initial temperatures $T_{si}$, the plurality of resistances $R_{hi}$, and the plurality of input powers $P_i$.

2. The method of claim 1, further comprising:

(F) identifying a resistance $R_h$ of the thermal print head element; and (G) using the estimate $\hat{f}(\cdot)$ to predict a temperature $T_h$ of the thermal print head element based on the resistance $R_h$.

3. The method of claim 2, wherein each of the plurality of initial temperatures $T_{si}$ falls within a temperature range, and wherein the predicted temperature $T_h$ falls outside of the temperature range.

4. The method of claim 3, wherein the thermal print head has a maximum permissible temperature, and wherein the predicted temperature $T_h$ is higher than the maximum permissible temperature.

5. The method of claim 1, wherein (E) comprises identifying the estimate $\hat{f}(\cdot)$ based on a model of change in the temperature $T_h$ of the thermal print head element in response of application of input power P to the thermal print head element.

6. The method of claim 5, wherein the model relates the thermal print head element temperature $T_h$ to a heat sink temperature $T_s$ and input power P by the equation $T_h=T_s+AP$ for a given value of A.

7. The method of claim 6, wherein (E) comprises identifying the estimate $\hat{f}(\cdot)$ and an estimate $\hat{A}$ of the parameter A using the equation:

$$[\hat{f}(\cdot), \hat{A}] = \arg\min_{f(\cdot),A} \sum_i \frac{1}{\sigma_i^2}(f(R_{hi}) - T_{si} - AP_i)^2,$$

wherein $\sigma_i$ is a standard deviation of noise on the print head element temperature $T_h$ arising from noise in the measurement triplet $\{R_{hi}, T_{si}, P_i\}$.

8. The method of claim 7, wherein (E) comprises identifying an estimate $\hat{x}$ of coefficients $$x = \begin{bmatrix} x_p \\ \vdots \\ x_0 \end{bmatrix}$$

of a polynomial representation $f(R)=x_pR_h^p+x_{p-1}R_h^{p-1}+\ldots+x_0$, of the function $f(\cdot)$, using the equation:

$$\begin{bmatrix} \hat{x} \\ \hat{A} \end{bmatrix} = (D^TWD)^{-1}D^TWT_s, \text{ wherein } T_s = \begin{bmatrix} T_{s1} \\ \vdots \\ T_{sN} \end{bmatrix},$$

$$W = \begin{bmatrix} 1/\sigma_1^2 & & \\ & \ddots & \\ & & 1/\sigma_N^2 \end{bmatrix}, D = [\, R_h^p \quad -P \,],$$

$$R_h^p = \begin{bmatrix} R_{h1}^p & \ldots & 1 \\ \vdots & & \vdots \\ R_{hN}^p & \ldots & 1 \end{bmatrix}, P = \begin{bmatrix} P_1 \\ \vdots \\ P_N \end{bmatrix},$$

and $\sigma_i$ is a standard deviation of noise on the print head element temperature $T_h$ arising from noise in the measurement triplet $\{R_{hi}, T_{si}, P_i\}$.

9. The method of claim 6, wherein (E) comprises identifying the estimate $\hat{f}(\cdot)$ and an estimate $\hat{A}$ of the parameter A using the equation:

$$[\hat{f}(\cdot), \hat{A}] = \arg\min_{f(\cdot),A} \sum_i \frac{1}{f'(R_{hi})^2}(f(R_{hi}) - T_{si} - AP_i)^2,$$

wherein $f'(\cdot)$ is the first derivative of $f(\cdot)$.

10. The method of claim 9, wherein (E) comprises identifying an estimate $\hat{x}$ of coefficients $$x = \begin{bmatrix} x_p \\ \vdots \\ x_0 \end{bmatrix}$$

of a model of the function $f(\cdot)$ by:

(E) (1) producing a current estimate of $\hat{f}'(\cdot)$;

(E) (2) computing a weight matrix $$W = \begin{bmatrix} 1/\hat{f}'(R_{h1})^2 & & \\ & \ddots & \\ & & 1/\hat{f}'(R_{hN})^2 \end{bmatrix}$$

based on the current estimate of $\hat{f}(\cdot)$; and (E) (3) producing a current estimate $\hat{x}$ of x based on the computed weight matrix W;

(E) (4) using the current estimate $\hat{x}$ to produce an estimate $\hat{f}(\cdot)$ of the function $f(\cdot)$;

(E) (5) computing a new estimate of $\hat{f}'(\cdot)$ from the estimate $\hat{f}(\cdot)$; and (E) (6) repeating (E)(2)-(E)(5) at least once.

11. The method of claim 6, wherein (E) comprises:

(E)(1) identifying a plurality of regions corresponding to a plurality of ranges of resistances;

(E)(2) for each of the plurality of regions, producing a polynomial approximation of the function $f(\cdot)$ within the region for the corresponding one of the plurality of ranges of resistances.

12. The method of claim 11, wherein the polynomial approximation for each of the plurality of regions is a linear approximation.

13. The method of claim 11, wherein (E) further comprises:

(E)(3) producing a continuous approximation of the function $f(\cdot)$ based on the plurality of polynomial approximations produced in (E)(2).

14. The method of claim 6, wherein (E) comprises identifying the estimate $\hat{f}(\cdot)$ as an estimate $$\hat{f}(R_h) = \sum_{m=1}^{M} \hat{x}_m B_m^p(R_h),$$

wherein $B_m^p(\cdot|k_m, \ldots, k_{m+p})$ is the $m^{th}$ B-spline of order p for a knot sequence $k_1 \leqq k_2 \leqq \ldots \leqq k_{M+p}$, and wherein m ranges from 1 to M.

15. The method of claim 14, wherein (E) comprises:

(E)(1) sorting the plurality of resistances $R_{hi}$;

(E)(2) placing a knot at every $(N/M)^{th}$ one of the sorted plurality of resistances; and (E)(3) identifying estimates $\hat{x}$ and $\hat{A}$ using the equation $$\begin{bmatrix} \hat{x} \\ \hat{A} \end{bmatrix} = (D^T W D)^{-1} D^T W T_s, \quad \text{wherein}$$

$$\hat{x} = \begin{bmatrix} \hat{x}_1 \\ \vdots \\ \hat{x}_M \end{bmatrix}, T_s = \begin{bmatrix} T_{s1} \\ \vdots \\ T_{sN} \end{bmatrix}, W = \begin{bmatrix} 1/\sigma_1^2 & & \\ & \ddots & \\ & & 1/\sigma_N^2 \end{bmatrix},$$

$$D = \begin{bmatrix} B_1^P(R_{h1}) & \cdots & B_M^P(R_{h1}) & -P_1 \\ \vdots & \ddots & \vdots & \vdots \\ B_1^P(RN) & \cdots & B_M^P(R_{hN}) & -P_N \end{bmatrix},$$

and $\sigma_i$ is a standard deviation of noise on the print head element temperature $T_h$ arising from noise in the measurement triplet $\{R_{hi}, T_{si}, P_i\}$; and (E)(4) identifying the estimate $\hat{f}(\cdot)$ using the equation $$\hat{f}(R_h) = \sum_{m=1}^{M} \hat{x}_m B_m^p(R_h).$$

16. The method of claim 1, wherein (A) comprises selecting the plurality of initial temperatures $T_{si}$ to maximize SNR, wherein $$SNR = \frac{1}{N} \sum_i \frac{\Delta T_{si}^2}{\sigma_i^2},$$

$\Delta T_{si} = T_{si} - \overline{T}_s$, wherein $$\overline{T}_s = \frac{1}{N} \sum_i T_{si},$$

and wherein $\sigma_i$ is a standard deviation of noise on the print head element temperature $T_h$ arising from noise in the measurement triplet $\{R_{hi}, T_{si}, P_i\}$.

17. The method of claim 16, wherein (A) comprises selecting the plurality of initial temperatures $T_{si}$ to be uniformly distributed.

18. An apparatus for identifying an estimate $\hat{f}(\cdot)$ of a function $T_h = f(R_h)$ relating resistance $R_h$ of a thermal print head element in a thermal print head of a thermal printer to temperature $T_h$ of the thermal print head element, the apparatus comprising:

means for selecting a plurality N of initial temperatures $T_{si}$;

means for heating an insulated chamber containing the thermal print head to the plurality of initial temperatures $T_{si}$;

means for providing the thermal print head element with a plurality N of input powers $P_i$;

means for measuring a plurality N of resistances $R_{hi}$ resulting from application of the plurality of input powers $P_i$; and means for identifying the estimate $\hat{f}(\cdot)$ based on the plurality of initial temperatures $T_{si}$, the plurality of resistances $R_{hi}$, and the plurality of input powers $P_i$.

* * * * *

UNITED STATES PATENT AND TRADEMARK OFFICE

CERTIFICATE OF CORRECTION

PATENT NO. : 7,328,980 B2
APPLICATION NO. : 11/524476
DATED : February 12, 2008
INVENTOR(S) : Suhail S. Saquib et al.

It is certified that error appears in the above-identified patent and that said Letters Patent is hereby corrected as shown below:

On the face page, in field (56), under "Other Publications", in column 2, line 5, delete "Signam" and insert -- Signal --, therefor.

On the face page, in field (74), in "Attorney, Agent, or Firm", in column 2, line 1, delete "Platkin," and insert -- Plotkin, --, therefor.

In column 6, line 59, delete "$(R_{hi},P_i)T_{si})$" and insert -- $(R_{hi},P_i,T_{si})$ --, therefor.

In column 7, line 23, delete "(+0.5" and insert -- (±0.5 --, therefor.

In column 10, line 48, delete "$X_m$." and insert -- $x_m$. --, therefor.

In column 10, line 50, delete "f(·))" and insert -- f(·) --, therefor.

In column 12, line 10, delete "Âis" and insert -- Â is --, therefor.

In column 12, line 23, delete " $B_m{}^P(\cdot \mathbb{k}_m,$ " and insert

-- $B_m{}^P(\cdot \mathbb{k}_m,$ --, therefor.

In column 12, line 56, delete " $\hat{f}(\cdot)$ " and insert -- $\hat{f}(\cdot)$ --, therefor.

In column 13, line 30, delete "ŝis" and insert -- ŝ is --, therefor.

UNITED STATES PATENT AND TRADEMARK OFFICE

CERTIFICATE OF CORRECTION

PATENT NO. : 7,328,980 B2
APPLICATION NO. : 11/524476
DATED : February 12, 2008
INVENTOR(S) : Suhail S. Saquib et al.

It is certified that error appears in the above-identified patent and that said Letters Patent is hereby corrected as shown below:

In column 13, lines 39-43, delete " $\hat{s} = \frac{\sum_i \frac{1}{\sigma_i^2} \Delta T_{si}(f(R_{hi}) - \overline{T}_s - AP_i)}{\sum_i \frac{1}{\sigma_i^2}(f(R_{hi}) - \overline{T}_s - AP_i)^2}$, " and insert -- $\hat{s} = \frac{\sum_i \frac{1}{\sigma_i^2} \Delta T_{si}(f(R_{hi}) - \overline{T}_s - AP_i)}{\sum_i \frac{1}{\sigma_i^2}(f(R_{hi}) - \overline{T}_s - AP_i)^2}$, --, therefor.

In column 13, line 50, delete " $E[n_{ik}^2] = \sigma_i^2$, " and insert

-- $E[n_i^2] = \sigma_i^2$, --, therefor.

In column 14, line 54, delete "SNRs.," and insert -- SNRs, --, therefor.

In column 16, line 21, delete "$T_s$." and insert -- $T_s$ --, therefor.

In column 16, line 48, delete "2;" and insert -- 2, --, therefor.

In column 16, line 48, before "substituted" insert -- A/T --.

In column 16, line 48, delete "A/T," and insert -- A, --, therefor.

In column 16, line 66, after " $\hat{f}(\cdot)$ " insert -- , --.

In column 18, line 66, after "13A)" insert -- , --.

UNITED STATES PATENT AND TRADEMARK OFFICE

CERTIFICATE OF CORRECTION

PATENT NO. : 7,328,980 B2
APPLICATION NO. : 11/524476
DATED : February 12, 2008
INVENTOR(S) : Suhail S. Saquib et al.

It is certified that error appears in the above-identified patent and that said Letters Patent is hereby corrected as shown below:

In column 22, line 65, in Claim 10, delete " $\hat{f}(\cdot);$ " and insert -- $\hat{f}^{+}(\cdot)$ ; --, therefor.

In column 23, lines 47-50, In Claim 15, delete " $D=\begin{bmatrix} B_1^p(R_{h1}) & \cdots & B_M^p(R_{h1}) & -P_1 \\ \vdots & \ddots & \vdots & \vdots \\ B_1^p(RN) & \cdots & B_M^p(R_{hN}) & -P_N \end{bmatrix},$ " and insert -- $D=\begin{bmatrix} B_1^p(R_{h1}) & \cdots & B_M^p(R_{h1}) & -P_1 \\ \vdots & \ddots & \vdots & \vdots \\ B_1^p(RN) & \cdots & B_M^p(R_{hN}) & -P_N \end{bmatrix},$ --, therefor.

Signed and Sealed this

Twenty-ninth Day of July, 2008

Jon W. Dudas

JON W. DUDAS
*Director of the United States Patent and Trademark Office*